US011096495B2

(12) United States Patent
Yajima et al.

(10) Patent No.: US 11,096,495 B2
(45) Date of Patent: Aug. 24, 2021

(54) CHAIR

(71) Applicants: KOKUYO CO., LTD., Osaka (JP); TAKANO CO., LTD., Nagano (JP)

(72) Inventors: Toshiki Yajima, Osaka (JP); Takao Sugano, Osaka (JP); Yasuhiro Shibamoto, Osaka (JP); Fei Xu, China (CN); Kenta Shiozawa, Kamiina-gun (JP); Tomoaki Ichikawa, Kamiina-gun (JP); Kensuke Nakamura, Kamiina-gun (JP)

(73) Assignees: KOKUYO CO., LTD., Osaka (JP); TAKANO CO., LTD., Nagano (JP)

( * ) Notice: Subject to any disclaimer, the term of this patent is extended or adjusted under 35 U.S.C. 154(b) by 0 days.

(21) Appl. No.: 16/614,954

(22) PCT Filed: Jun. 20, 2017

(86) PCT No.: PCT/JP2017/022761
§ 371 (c)(1),
(2) Date: Nov. 19, 2019

(87) PCT Pub. No.: WO2018/235176
PCT Pub. Date: Dec. 27, 2018

(65) Prior Publication Data

US 2020/0196763 A1 Jun. 25, 2020

(51) Int. Cl.

| | |
|---|---|
| ***A47C 7/14*** | (2006.01) |
| *A47C 7/00* | (2006.01) |
| *A47C 7/44* | (2006.01) |

(52) U.S. Cl.
CPC ..... *A47C 7/14* (2013.01); *A47C 7/006* (2013.01); *A47C 7/44* (2013.01)

(58) Field of Classification Search
CPC ..... A47C 7/14; A47C 7/006; A47C 7/44
See application file for complete search history.

(56) References Cited

U.S. PATENT DOCUMENTS 4,183,492 A * 1/1980 Meiller ..... B60N 2/02 248/395
5,603,551 A 2/1997 Sheehan
(Continued)

FOREIGN PATENT DOCUMENTS

DE 20 2012 006249 U1 10/2013
EP 1 172 049 A1 1/2002
(Continued)

OTHER PUBLICATIONS

Extended (Supplementary) European Search Report dated Oct. 8, 2020, issued in counterpart EP Application No. 17915037.0. (5 pages).
(Continued)

*Primary Examiner* — Philip F Gabler
(74) *Attorney, Agent, or Firm* — Westerman, Hattori, Daniels & Adrian, LLP

(57) ABSTRACT

A flange part 31*b* is provided on a vertical surface 31*a* on the plate member PM of the front-rear swing part 3, the flange part 31*b* has a guide surface 31*b*1 extending to lateral direction and moving the rolling body 45 in the longitudinal direction, a lateral direction dimension of the guide surface 31*b*1 is greater than a thickness of the plate member PM, the flange part 31*b* and the portion of the plate member PM forming the vertical surface 31*a* around the flange part 31*b* are integrally formed of metal; and the flange part 31*b* has a shape that goes around the circumference of the guide hole 34 opened in the vertical surface 31*a*, and then, the rolling body 45 are provided independently to the left and right, to be able to a roll along the guide surface 31*b*1.

8 Claims, 40 Drawing Sheets

(56) References Cited

U.S. PATENT DOCUMENTS

| | | | | |
|---|---|---|---|---|
| 6,890,030 | B2 * | 5/2005 | Wilkerson | A47C 1/023 297/284.11 |
| 8,613,482 | B2 * | 12/2013 | Ni | A47C 1/026 297/302.3 |
| 9,693,632 | B2 * | 7/2017 | Duke | A47C 7/006 |
| 10,820,704 | B2 * | 11/2020 | Sugano | A47C 7/14 |
| 10,842,276 | B2 * | 11/2020 | Sugano | A47C 3/027 |
| 10,856,660 | B2 * | 12/2020 | Kinoshita | A47C 3/026 |
| 2014/0103689 | A1 * | 4/2014 | Birkbeck | A47C 1/03277 297/300.1 |
| 2015/0201758 | A1 | 7/2015 | Serber | |
| 2019/0045928 | A1 * | 2/2019 | Yajima | A47C 7/004 |
| 2019/0343286 | A1 * | 11/2019 | Sugano | A47C 3/026 |
| 2020/0085195 | A1 * | 3/2020 | Shibamoto | A47C 3/0255 |
| 2020/0196763 | A1 * | 6/2020 | Yajima | A47C 3/0255 |
| 2020/0196764 | A1 * | 6/2020 | Yajima | A47C 3/03 |
| 2020/0205573 | A1 * | 7/2020 | Yajima | A47C 3/026 |
| 2020/0315352 | A1 * | 10/2020 | Sugano | A47C 3/025 |
| 2020/0315355 | A1 * | 10/2020 | Shibamoto | A47C 7/566 |

FOREIGN PATENT DOCUMENTS

| | | | |
|---|---|---|---|
| EP | 2 387 913 | A1 | 11/2011 |
| JP | 10-129 | A | 1/1998 |
| JP | 2002-34708 | A | 2/2002 |
| JP | 2004-8440 | A | 1/2004 |
| JP | 2009-293693 | A | 12/2009 |
| JP | 2011-161123 | A | 8/2011 |
| JP | 6000085 | B2 | 9/2016 |

OTHER PUBLICATIONS

International Search Report dated Sep. 19, 2017, issued in counterpart application No. PCT/JP2017/022761 (2 pages).

* cited by examiner

CHAIR

TECHNICAL FIELD

The present invention relates to a chair suitably used in an office and the like.

BACKGROUND ART

Some of office chairs are provided with movable part in supporting portions such as a seat and a back in order to appropriately support a seated person.

Such office chairs are shown in Patent Documents 1 and 2, and realize a desired operation by moving a follower along a guide surface.

The chairs in these documents includes a first shaft and a second shaft, the first shaft provided at the rear part of the seat is movably engaged with a first guide groove provided at the support base part side, the second shaft provided at the front part of the seat is movably engaged with a second guide groove provided at the support base part side of the office chair, and thereby associates forward tilt and reward tilt movements of the back and seat with the front-rear movements of the back and seat.

However, these chairs are configured that the guide groove is formed by opening a hole in a guide plate which forms a vertical wall. Accordingly, in order to secure require strength, there is a subject that the guide plate becomes thicker.

The chair described in the Patent Documents 2 is configured so that a resin-made guide plate having a guide groove with a required width is attached to the outer side of the vertical wall, and a hole larger than the guide groove is provided in the vertical wall, and the shaft is inserted through the guide groove to be supported by the guide groove of the guide plate.

According to the configuration of Patent Document 2, in order to secure the pressure receiving area, it is sufficient to thicken only the resin member.

However, such a movable part is a part that moves under the load applied by seated person. In view of having to endure severe use for a long time, when the shaft has a higher hardness than the guide groove, the softer guide groove may be deformed or scraped, leading to rattling or damage to the movable portion. Further, since the number of parts is also increased, this may also be a causes of cost increase.

On the other hand, in the case of Patent Documents 3, the cylindrical part in which the shaft is freely movable fitted is formed by burring processing on at a member made of a metal plate. And a cylindrical part increases height of protrusion without damaging in a burring process, and the support strength of the shaft can be improved.

Specifically, the length of the long hole is made considerably larger than the movement stroke of the shaft, and the projecting dimension is made smaller at the both ends of the long hole in the cylindrical part. And the projecting dimension is made larger in the moving range of the shaft. Since the cylindrical part has small projecting dimensions at both ends of the long hole, the cylindrical part is not broken in the burring processing. The stroke regulation of the shaft is performed at a portion other than the long hole or by thickening the thickness of both left and right ends part of the bush.

CITATION LIST

Patent Literature

Patent Document 1: U.S. Pat. No. 5,603,551
Patent Document 2: JP Patent No. 6000085
Patent Document 3: Japanese Unexamined Patent Application Publication No. 2002-034708

SUMMARY OF THE INVENTION

Problem to be Solved by the Invention

However, in the chair described in the Patent Document 3, the front-rear movement of the seat is only supported, and further, shaft merely performs a slide operation with respect to the long hole.

For this reason, when trying to configure a chair which can operate to the front, rear, right, or left in a state where a seat receives a load applied by seated person, a shaft twists with respect to a left and right long holes, and it will be in a state which is hard to move. Further, when the seat moves the front, rear, right, or left, it is conceivable that one of the left and right sides of the seat will be higher than the other. In this case, the shaft may be in contact with the lower edge of one of the left and right long holes and the other at the upper edge. And, it is also conceivable that the shaft receive such a force that one of the left and right moves forward or rotates forward and the other moves backward or rotates backward.

Thus, in order to support such a chair, it is essential to review the guide structure with the long hole and the shaft.

The present invention focuses on such problems and an object thereof is to realize a chair, and the chair can appropriately support a chair whose seat moves the front, rear, right, or left with a simple structure.

Means for Solving the Problem

The present invention adopts the following means to achieve such object.

That is, in a chair according to the present invention, a movable portion that moves in the state of receiving a load applied by seated person is configured to be operable to the front, rear, right, or left with respect to the support base portion, a flange part is provided on a vertical surface on the plate member of the movable portion or support base portion, and the flange part has a guide surface extending lateral direction and moving the rolling body in the longitudinal direction, and a lateral dimension of the guide surface is greater than a thickness of the plate member. The flange part and the portion of the plate member part forming the vertical surface around the flange part are integrally formed of metal; the flange part has a shape formed around the entire circumference of a guide hole opened in the vertical surface, the rolling body is provided so as to be roll independently on the left and right along the guide surface.

With such a configuration, the pressure receiving area of the guide hole in contact with the rolling body is increased, and load distribution can be achieved, resulting in improved durability. Furthermore, by providing the flange part integrally with the plate member of the movable portion with metal, high strength can be secured, and a rib effect by the flange part can also be expected. At the result, the rolling body can be reliably supported and easily rolled without thickening the plate member. Further, the chair that moves while sitting is particularly applied high load, so the present invention is particularly effective. Furthermore, when the movable part moves in the front, rear, right, or left in the state of receiving a load applied by seated person, even if the shaft center positions of the left and right rolling bodies are shifted the guide surface, the operation can be secured. Further, even if one of the left and right part of the movable portion is higher than the other part when the movable portion operates a front-rear direction and a right-left direction, one of the rolling body can be in contact with the lower edge of the guide surface and the other with the upper edge of the guide surface, and the rolling body can perform an operation in which one of left and right moves rolling body forward or rotates forward and the other moves backward or rotates backward, so that it is possible to appropriately respond to right and left unbalanced external force or movement.

In consideration of the region where the rolling body is in contact, it is desirable that the lateral dimension of the guide surface be substantially uniform over the entire circumference.

In order to obtain the height and the smoothness of the guide surface, it is desirable that the flange part is formed by plastic deformation processing of the plate member around the guide hole.

In consideration of the swing of the chair to left and right, it is desirable that the flange part is formed to extend from the guide hole outward the left-right direction of the chair.

In order to enhance the durability and the strength, it is desirable that an end part of the guide hole has a shockless shape that lefts the center of gravity of the movable portion in order to mitigate a shock due to a collision with the rolling body.

To ensure smooth rotation with respect to the guide surface and strength against the guide surface, it is desirable that the rolling body is configured of a metal bearing.

To perform an appropriate processing without deforming the plate member, it is desirable that the shortest dimension from the both ends of the guide hole to the edge of the plate member is set 15 mm or more.

The present invention is extremely useful when applying to a chair in which the movable portion is supported by the support portion at two locations on the front and rear, any one of the front and rear support structures is configured by the rolling part and the guide surface, and the other support structure are configured by a different structure.

Effect of the Invention

According to this present invention, the new chair whose seat moves the front, rear, right, or left and supported appropriately with a simple structure can be provided.

BRIEF DESCRIPTION OF THE DRAWINGS

FIG. 21A is a conceptual diagram of the left-right stopper, FIG. 21B is a conceptual diagram of the front-rear stopper, and FIG. 21C is a conceptual diagram of the front-rear stopper when seated person leaves seat.

MODE FOR CARRYING OUT THE INVENTION

Figure 1:
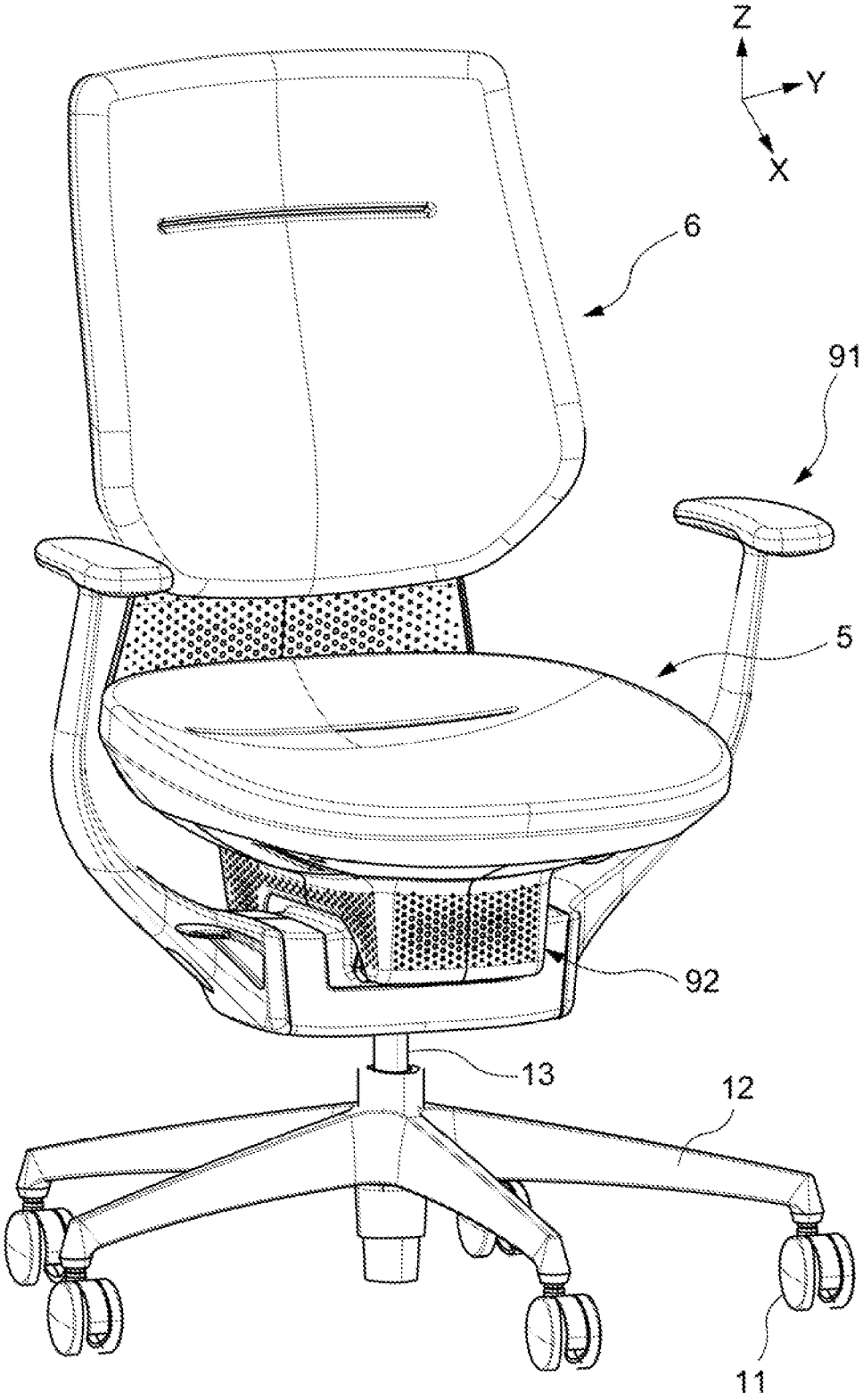
FIG. 1 is a perspective view, as viewed obliquely from the front, of a chair according to an embodiment of the present invention.

An embodiment of the present invention will be described below with reference to the drawings.

As illustrated in FIGS. 1 to 5, this chair is an office chair configured by erecting a leg supporting post 13 incorporating a lifting/lowering mechanism therein, in a central part of a leg vane 12 supported by a caster 11, and attaching a support base part 2 rotatably at an upper end side of the leg supporting post 13. In the support base part 2, a seat 5 being a movable part is supported via a front-rear swing part 3 as a one-direction operating part (movable part) operable any one of a front-rear direction (X-direction in the drawings) and a right-left direction (Y-direction in the drawings) being two directions crossing each other, and a left-right swing part 4 being an other-direction operating part (support part) operable in the other of the front-rear direction and the left-right direction and the seat 5 can swing in the front-rear direction and the right-left direction with respect to the support base part 2. Specifically, the front-rear swing part 3 is provided between the seat 5 and the support base part 2 configured to support the seat 5, and the left-right swing part 4 is provided between the front-rear swing part 3 and the support base part 2. Behind the seat 5, a back 6 is arranged.

The support base part 2 functions as a structured body for receiving the load applied by seated person, and in the support base part 2, a left-right pair of arm attachment parts 23 is integrally formed with the support base part 2 via a bearing base part 22 on both left and right sides of a support base main body 21 including a through hole 21*a* along an up-down direction into which an upper end of the leg supporting post 13 is inserted. A shaft swing damper 21*b* is attached to the hole 21*a* opening on the surface of the support base main body 21 in the front-rear direction and upper ends of left-right swing links L1, L2 are attached to holes 22*a* opening on the front and rear surfaces of the bearing base part 22, via swing shafts S1, S2.

Figure 4:
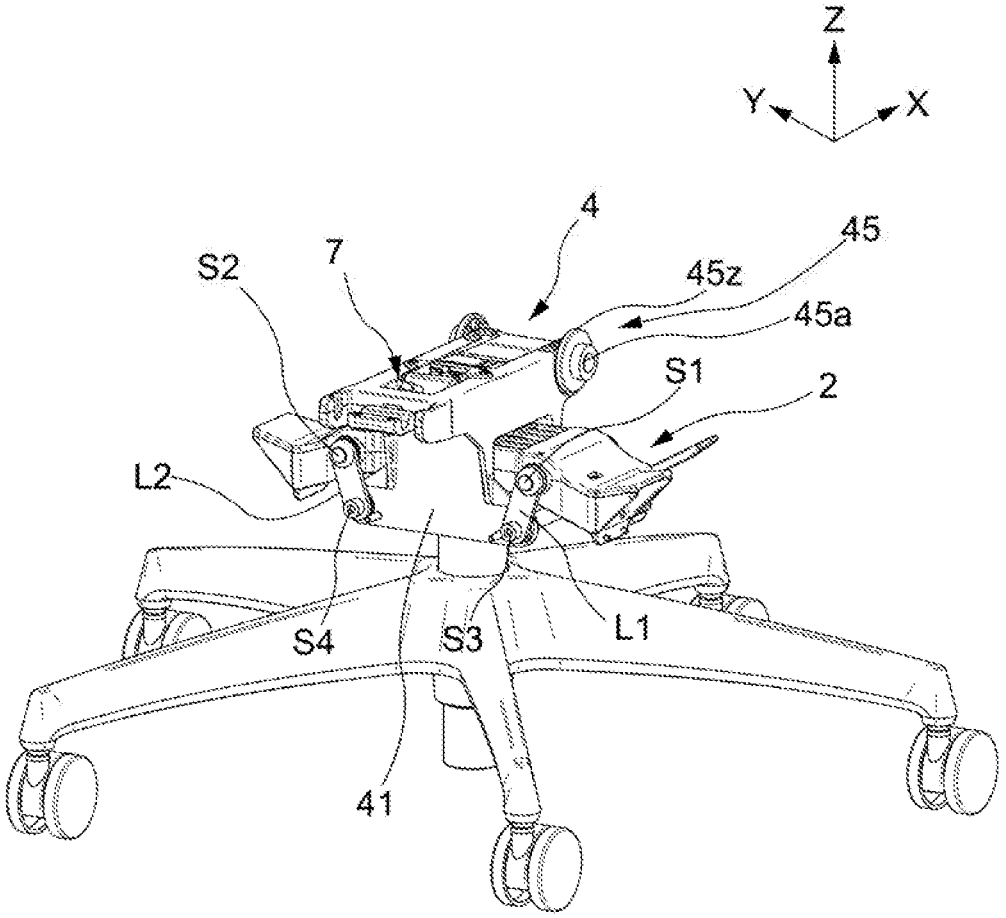
FIG. 4 is a perspective view illustrating a state where a left-right swing part is incorporated in a support base part of the chair.
Figure 5:
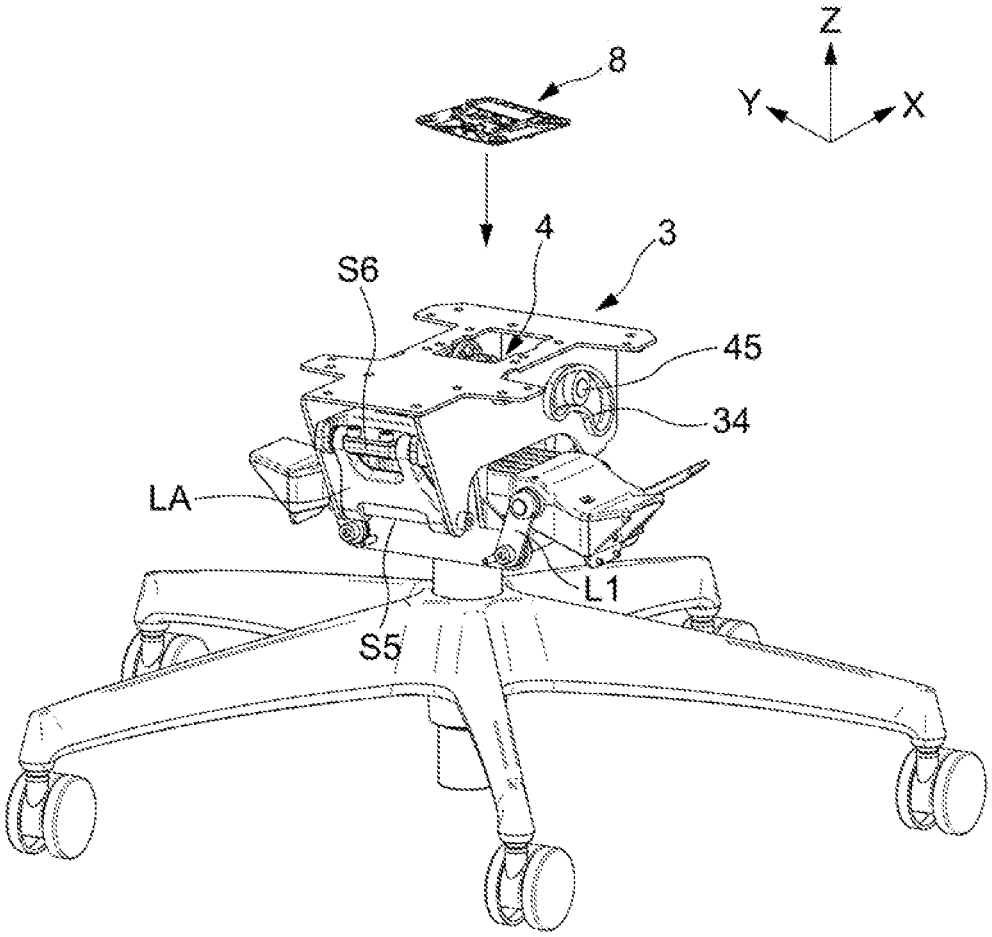
FIG. 5 is a perspective view illustrating a state where a front-rear swing part is incorporated in the left-right swing part.
Figure 6:
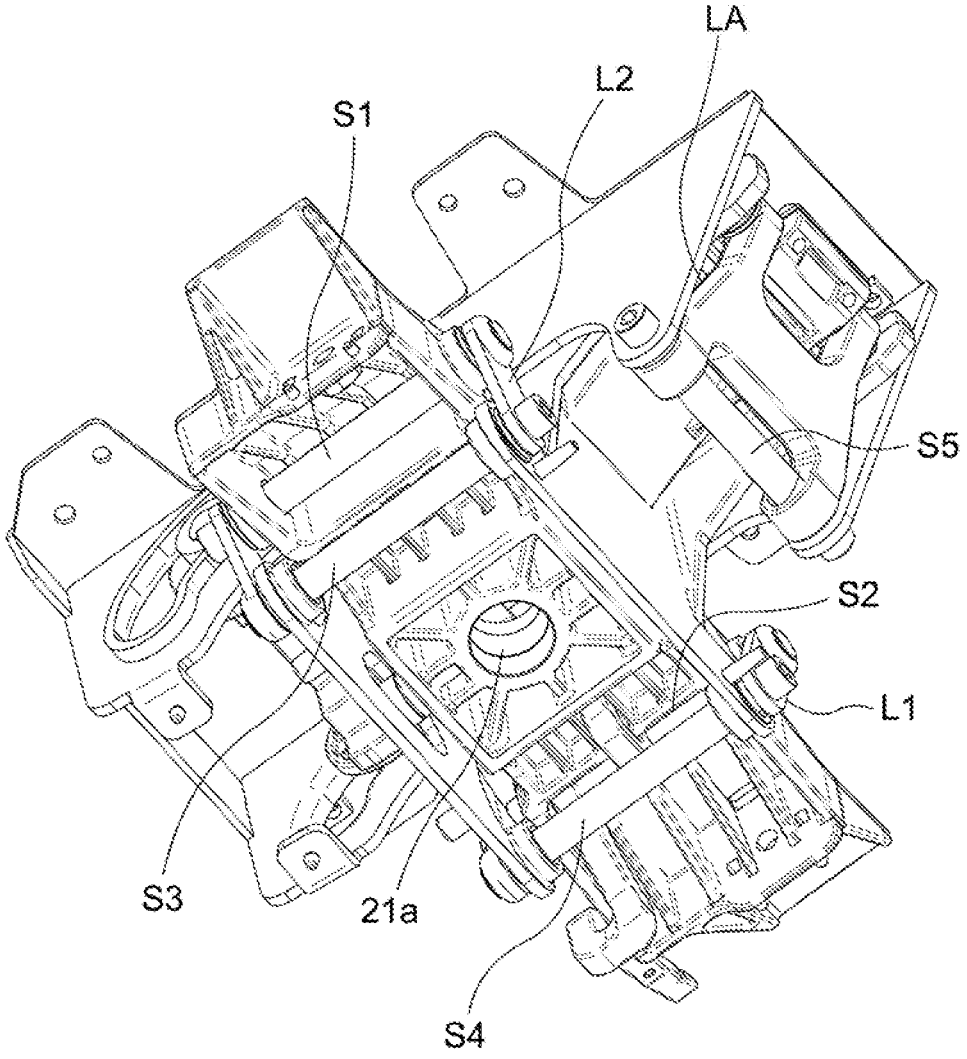
FIG. 6 is a perspective view of a part of FIG. 5, as viewed obliquely from below.
Figure 7:
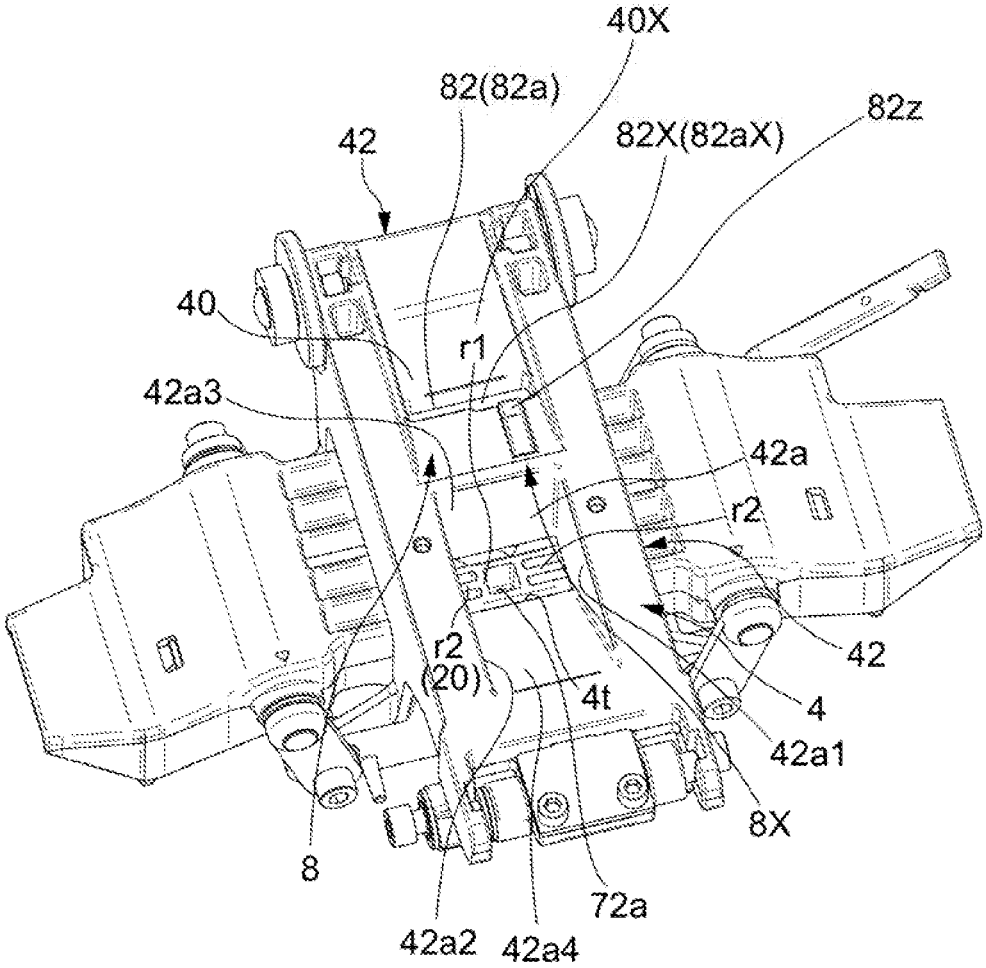
FIG. 7 is an enlarged perspective view illustrating a part of FIG. 4.
Figure 8:
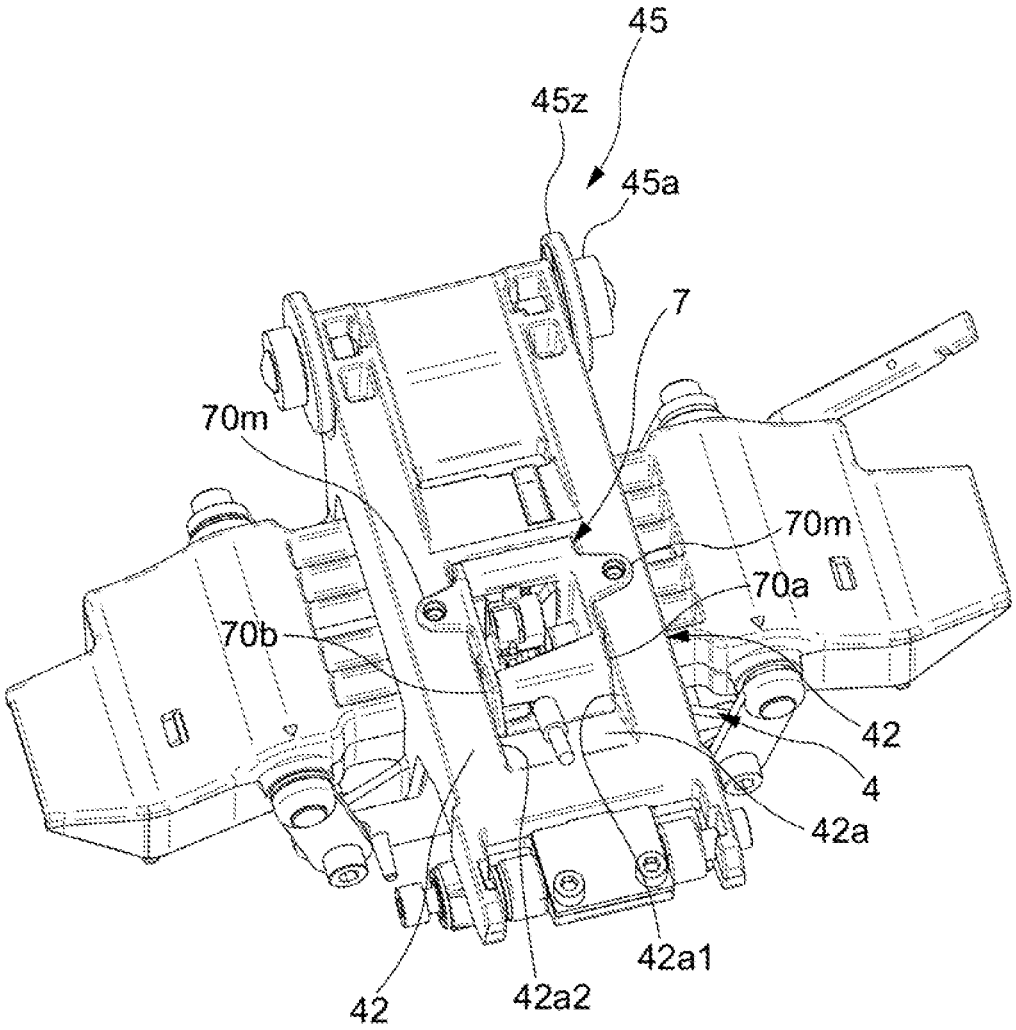
FIG. 8 is a perspective view of a state where a left-right stopper mechanism is incorporated in FIG. 4.

The left-right swing part 4 includes a pair of plate-shaped link bases 41 disposed separated from each other in the front-rear direction to perform a swinging operation in the left-right direction with respect to the support base part 2, and a left-right swing main body 42 configured to connect the pair of link bases 41, 41. At both left and right ends of the link bases 41, holes 41*a*, 41*a* are opened and the lower ends of the left-right swing links L1, L2 are attached via swing shafts S3, S4. FIG. 4 illustrates a state where the links L1, L2 are attached via the swing shafts S1 to S4. As illustrated in FIGS. 7 and 8, the left-right swing main body 42 is provided with a unit attached hole 42*a* penetrating in the up-down direction, and a later-described left-right lock unit 7 is attached to the unit attached hole 42*a*. That is, the left-right swing main body 42 is disposed in a suspended state to be swingable to the left and right with respect to the support base part 2 via the left-right swing links L1, L2, and the left-right swing links L1, L2 are attached so that the distance between the lower ends is smaller than the distance between the upper ends, as illustrated in FIG. 4 and the like.

Figure 9:
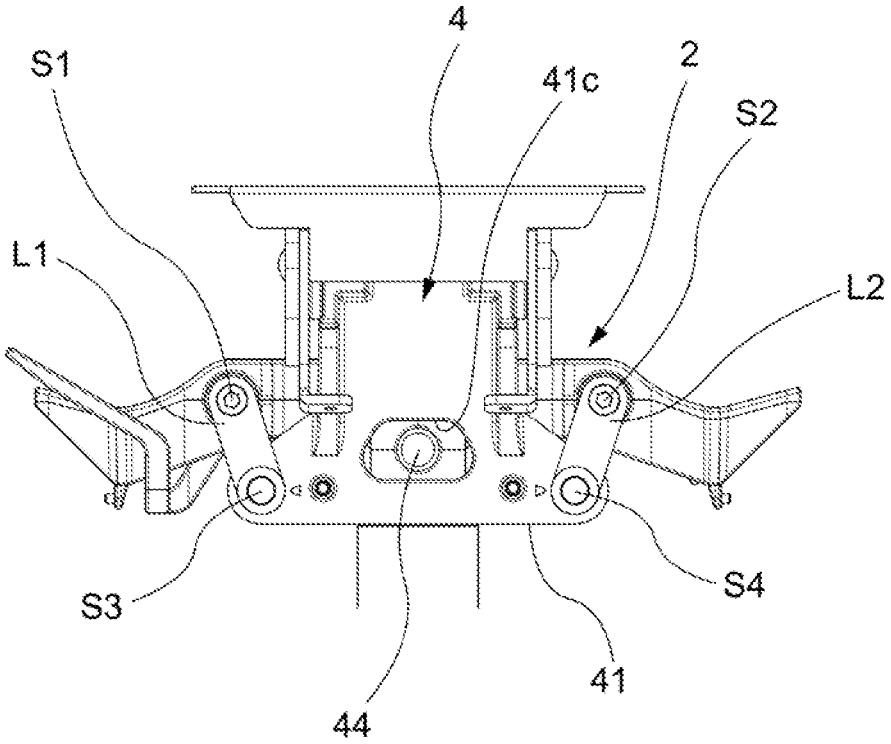
FIG. 9 is an operation explanatory diagram of the left-right swing part.
Figure 10:
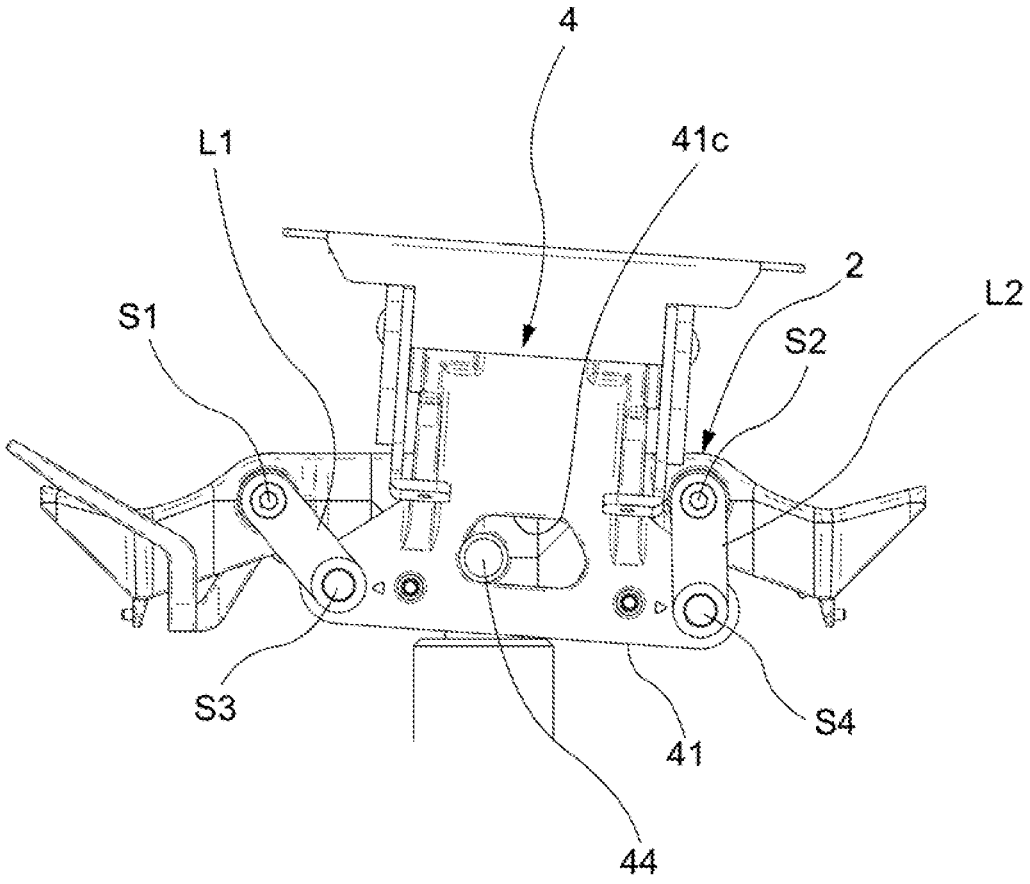
FIG. 10 is an operation explanatory diagram of the left-right swing part.

That is, as illustrated in FIGS. 9 and 10, when the left-right swing part 4 swings, the link L2 (L1) located at the swing destination approaches a vertical posture and the other link L1 (L2) approaches a horizontal posture, as a result of which an operation is performed in which a center of gravity of the left-right swing part 4 is lifted while tilting so that a moving tip side is lower.

A window 41*c* is opened at the center of the link base 41, a rolling damper 44 is positioned in the window 41*c*, and a swing range of the left-right swing part 4 is restricted to a range where the rolling damper 44 can perform a relative movement within the window 41*c*.

Figure 11:
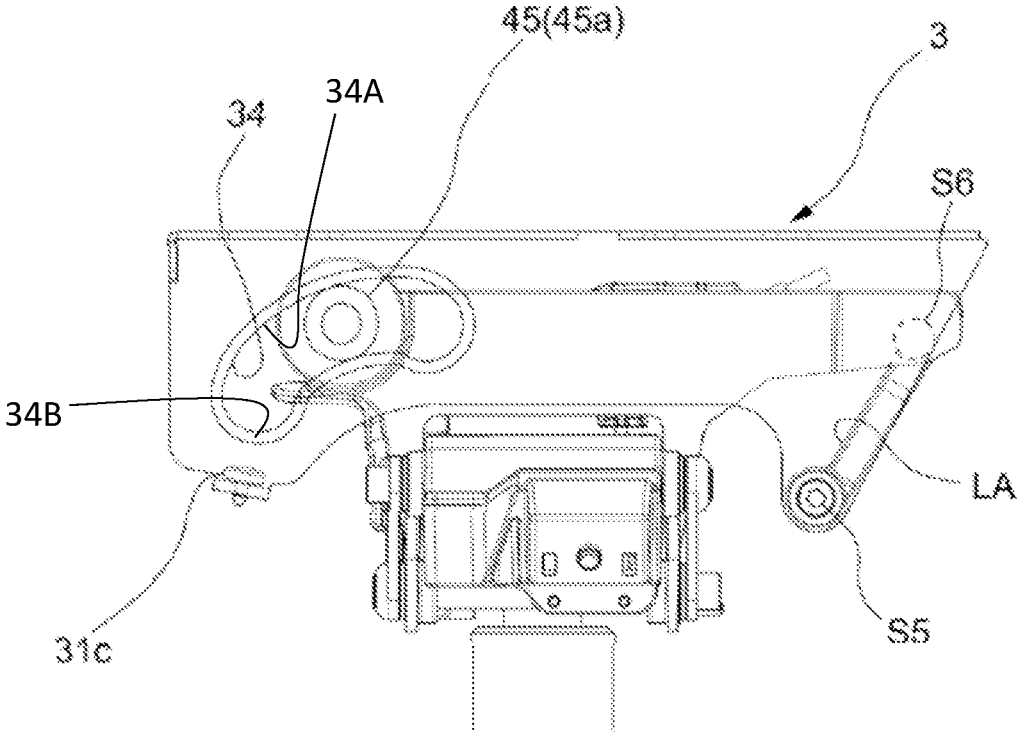
FIG. 11 is an operation explanatory diagram of the front-rear swing part, a part of which is illustrated transparently.
Figure 16:
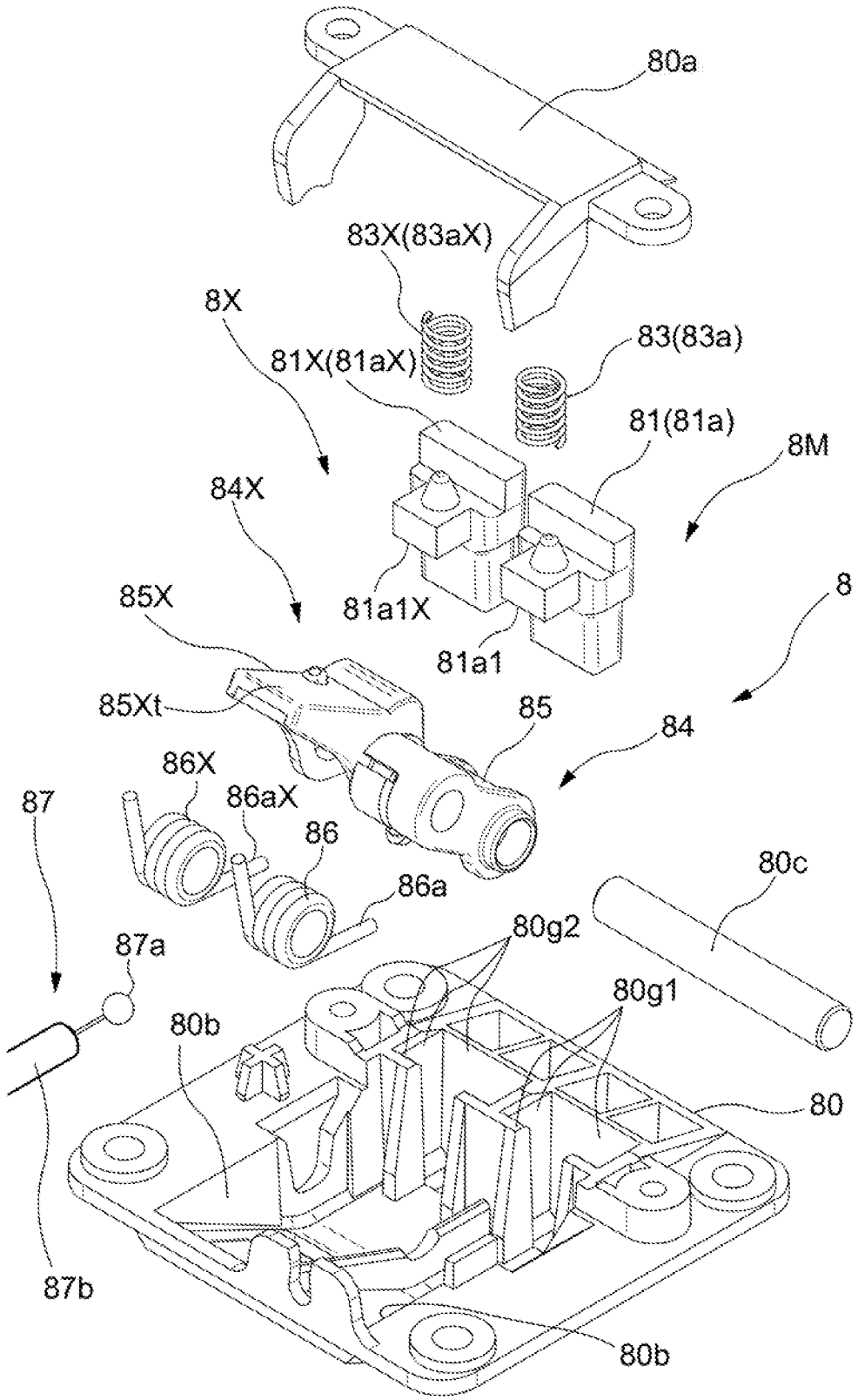
FIG. 16 is an exploded perspective view of a control mechanism and a front-rear stopper mechanism configured to suppress a front-rear operation.
Figure 27:
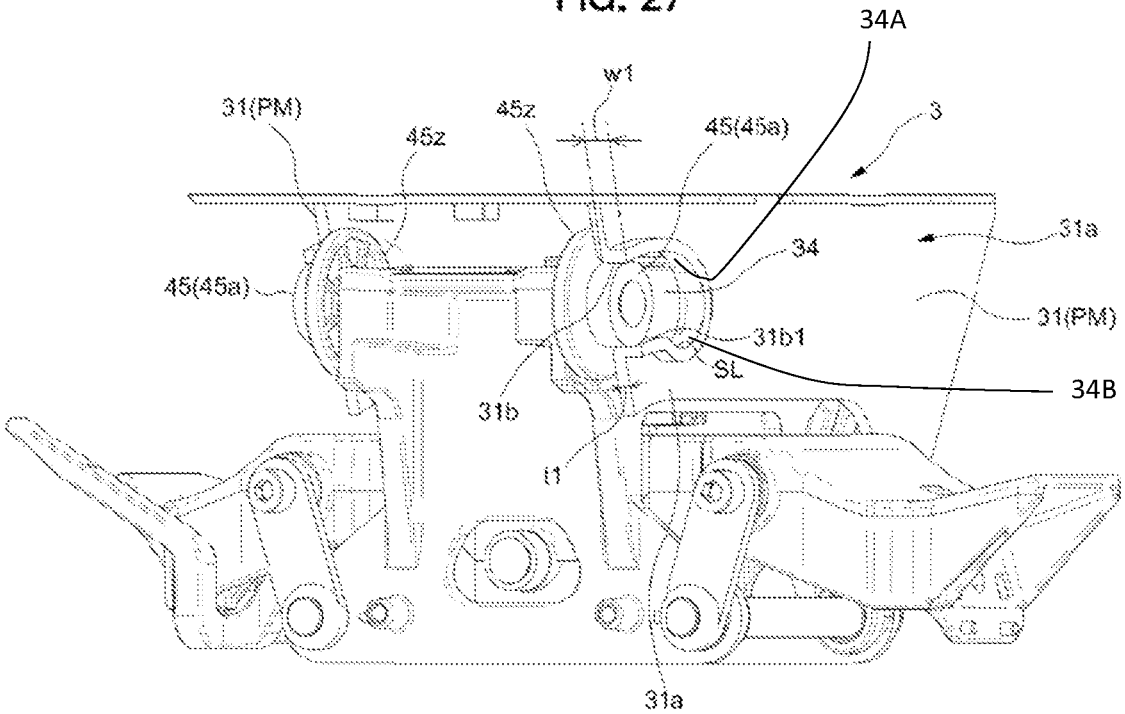
FIG. 27 is a partially broken perspective view illustrating an engaging portion of a bearing and a guide hole in the embodiment.

The front-rear swing part 3 includes a pair of plate-shaped rail plates 31, 31 disposed separated from each other in the left-right direction to perform a swinging operation in the front-rear direction with respect to the left-right swing part 4, and an upper connection plate 32 and a front connection plate 33 configured to connect the pair of rail plates 31, 31. At a front side of the rail plates 31, a guide hole 34 is provided to penetrate the rail plates 31, a bearing 45*a* is engaged in the guide hole 34, and the bearing 45*a* is a rolling body 45 provided to be rollable independently to the left and right on a side surface at a front end side of the left-right swing main body 42. The reference sign 45*z* in the drawings indicates a spacer disposed on an inner surface side of the rail plate 31 and having a diameter larger than that of the bearing 45*a*. The rear end side of the rail plate 31 extends rearward and downward, a lower end of a link arm LA, being a swingable front-rear swing link, is attached via a swing shaft S5 to an extension end of the rail plate 31, and the upper end of the link arm LA is supported by the rear end of the left-right swing body 4 via a swing shaft S6. That is, the rear end of the front-rear swing part 3 is disposed in a suspended state to be swingable forward and rearward with respect to the left-right swing part 4 via the link arm LA. The guide hole 34 has a shape that is gently curved forward and downward from the rear end side toward the front end side, and at the rear end, there is provided a shockless part SL configured to mitigate a shock when the front-rear swing part 3 moves forward together with the seat 5. The upper connection plate 32 is provided with a unit attached hole 32*a* penetrating in the up-down direction, and a front-rear lock unit 8 described later based on FIG. 16 is attached to the unit attached hole 32*a*. Axles of the bearing 45*a* being the rolling body 45 in the example of the drawings are separated to the left and right. However, as long as the bearing 45*a* being the rolling body 45 is rollable independently to the left and right, the axle may be common. As shown in FIGS. 11 and 27, wherein the entire circumference of the guide hole 34 includes a first circumference part 34A and a second circumference part 34B such that a radius of the second arc is shorter than a radius of the first arc.

Figure 12:
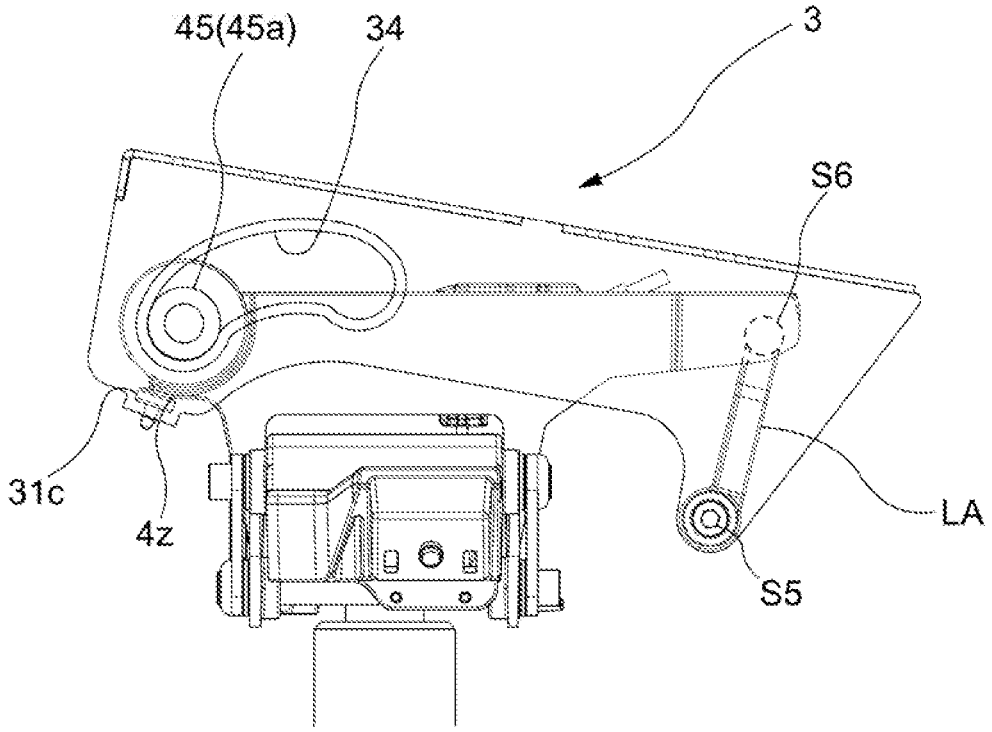
FIG. 12 is an operation explanatory diagram of the front-rear swing part, a part of which is illustrated transparently.
Figure 13:
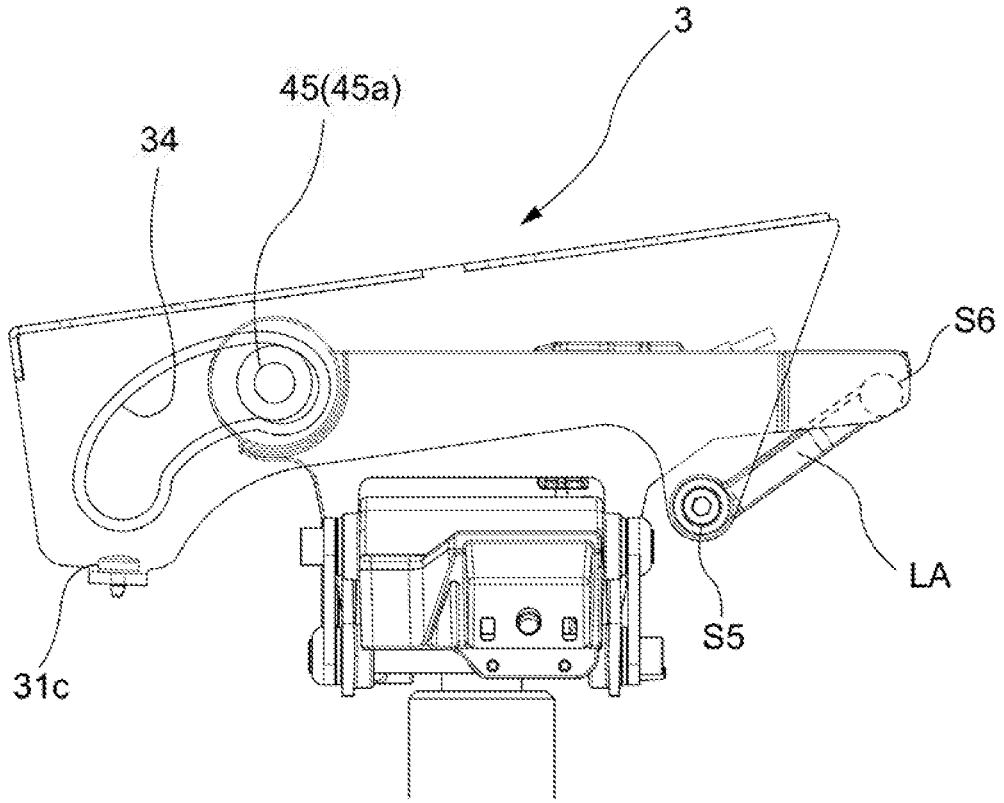
FIG. 13 is an operation explanatory diagram of the front-rear swing part, a part of which is illustrated transparently.

That is, when the front-rear swing part 3 moves rearward, as illustrated in FIG. 12, from the state of FIG. 11 where the upper surface of the front-rear swing part 3 takes a substantially horizontal posture, the bearing 45*a* performs a relative movement with respect to the front end side of the guide hole 34 at the front end of the front-rear swing part 3, so that the front end side of the front-rear swing part 3 is lifted to a high position, and the link arm LA approaches a vertical posture. As a result, an operation is performed where the rear end side of the front-rear swing part 3 is guided to a lower position. Conversely, when the front-rear swing part 3 moves forward, as illustrated in FIG. 13, from the state of FIG. 11, the bearing 45*a* performs a relative movement with respect to the rear end side of the guide hole 34 at the front end of the front-rear swing part 3, so that the front end side of the front-rear swing part 3 is guided to a lower position, and the link arm LA approaches a horizontal posture. As a result, an operation is performed where the rear end of the front-rear swing part 3 is lifted to a higher position. That is, the front-rear swing part 3 performs an inclining operation so that the moving tip side is also lower in the front-rear direction.

On the front end side of the rail plate 31 included in the front-rear swing part 3, a pitching damper 31*c* formed by bending a part of the rail plate 31 is provided, and when swinging rearward, the front-rear swing part 3 abuts against a front end lower part 4*z* (see FIG. 3) of the left-right swing part 4 in the vicinity of the swing end to mitigate the shock at the rearward movement end.

Figure 14:
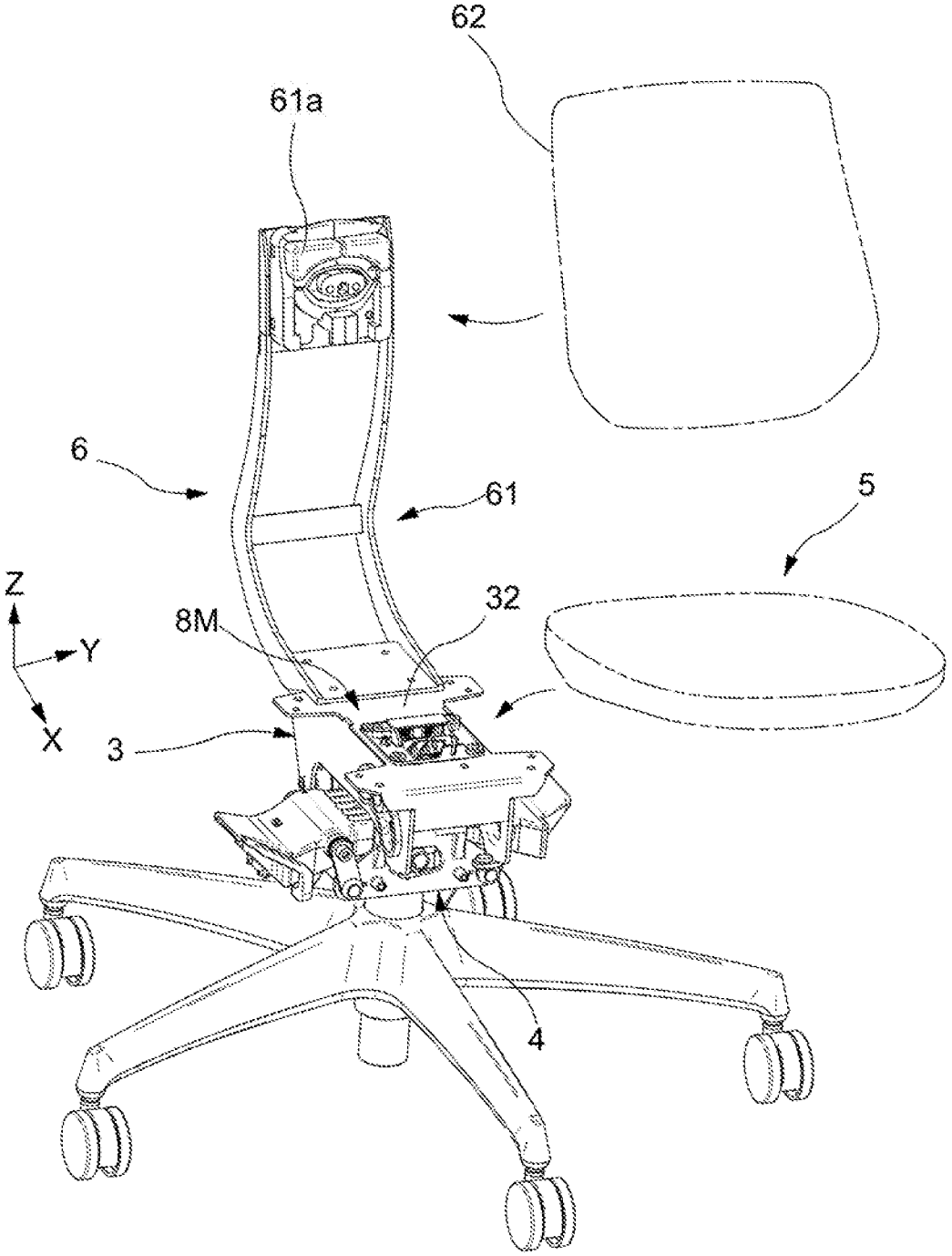
FIG. 14 is an exploded perspective view illustrating a relationship between the front-rear swing part and a back.

As illustrated in FIG. 14, a back frame 61 included in the back 6 is attached to a rear part of the upper connection plate 32 included in a front-rear swing part 3, and a seat outer shell 51 (see FIG. 15) included in the seat 5 is attached to the connection plate 32 from above. That is, when the back frame 61 configured to support a backrest 62 is erected integrally behind the seat 5 and the seat 5 swings in the front-rear and left-right directions with respect to the support base part 2, as indicated by X and Y in the drawing, the back frame 61 also moves together with the seat 5, but the backrest 62 according to the present embodiment operates separately from the back frame 61 and the seat 5, as described later.

Figure 15:
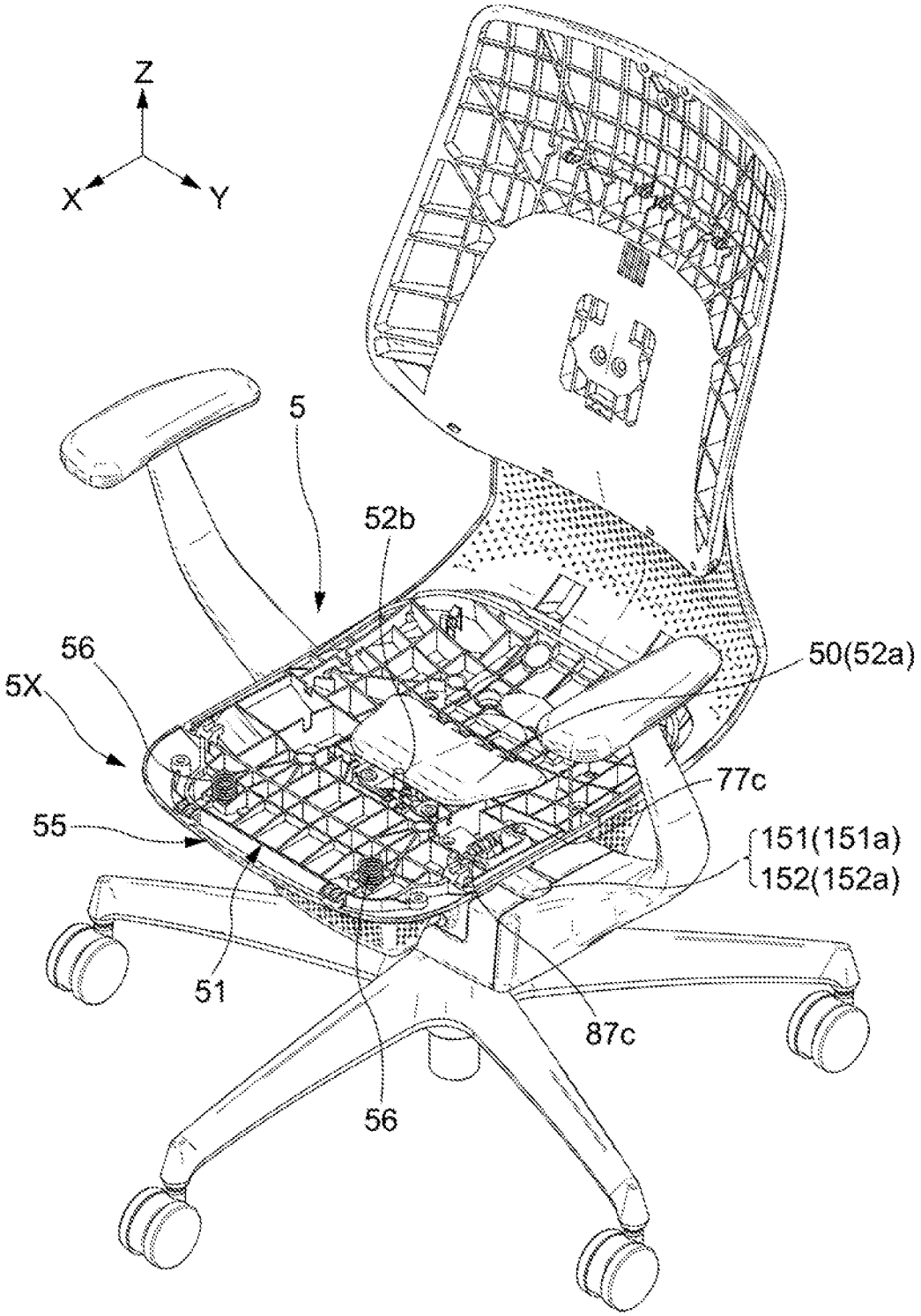
FIG. 15 is a perspective view illustrating a weight-receiving part provided on a seat.
Figure 17:
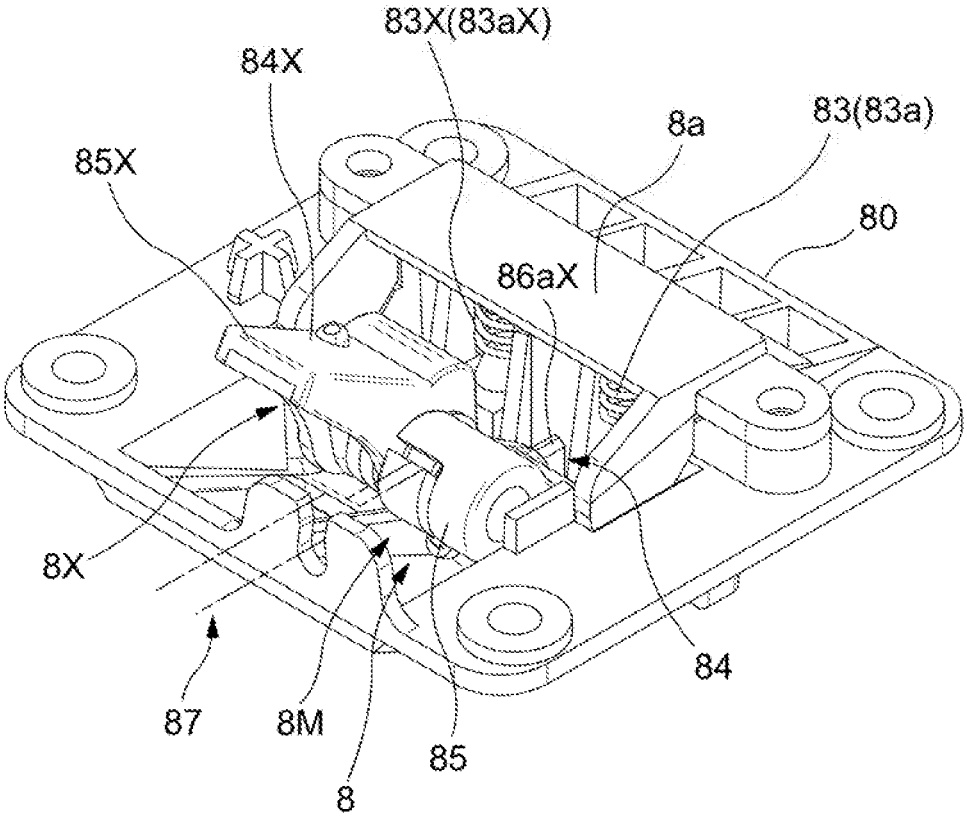
FIG. 17 is a perspective view of the assembled control mechanism and front-rear stopper mechanism configured to suppress a front-rear operation.
Figure 18:
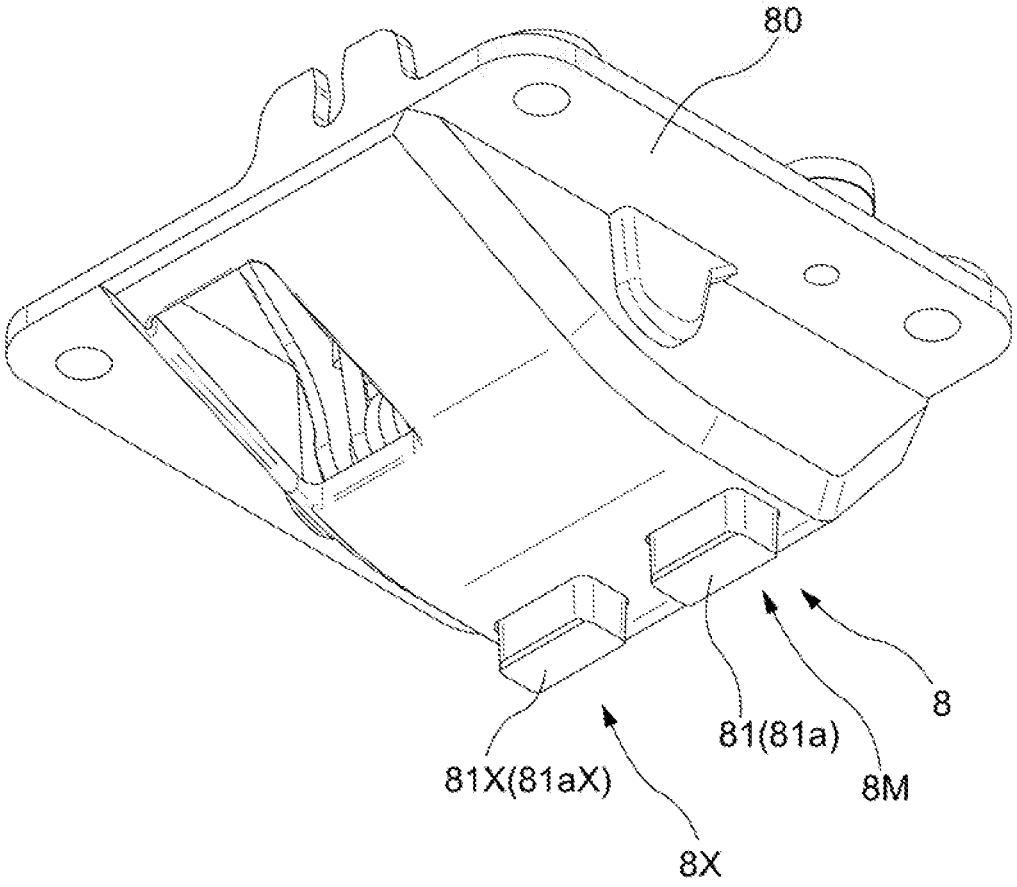
FIG. 18 is a perspective view of FIG. 17, as viewed obliquely from below.

A front-rear stopper mechanism 8M utilizing the front-rear lock unit 8 illustrated in FIGS. 16 to 18 is provided to suppress a swinging of the seat 5 in the front-rear direction relative to the support base part 2 at a predetermined position through an operation of an operating member 152 illustrated in FIG. 15. A left-right stopper mechanism 7M utilizing the left-right lock unit 7 illustrated in FIGS. 19 and 20 is provided to suppress a swinging of the seat 5 in the left-right direction relative to the support base part 2 at a position determined in advance through an operation of an operating member 151 (being an operating member common with the operating member 152 in practice) illustrated in FIG. 15.

In this embodiment, the left-right swing part 4 is supported by the support base part 2 and the front-rear swing part 3 is supported by the left-right swing part 4 so that a layered structure is formed in which the left-right stopper mechanism 7M is provided between the support base part 2 and the left-right swing part 4, and the front-rear stopper mechanism 8M is provided between the left-right swing part 4 and the front-rear swing part 3.

Figure 3:
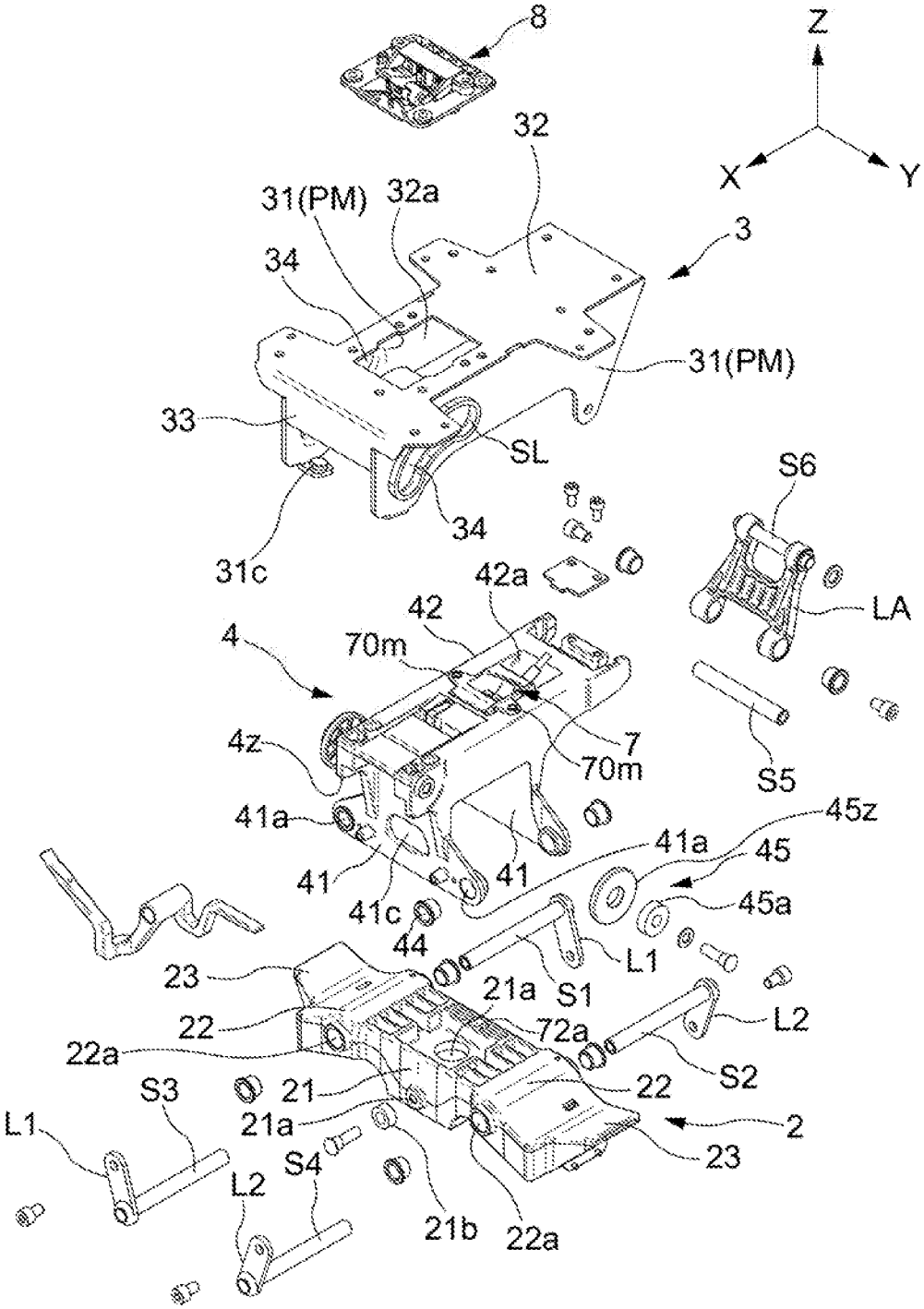
FIG. 3 is an exploded perspective view of front, rear, right, or left support portions in the chair.
Figure 20:
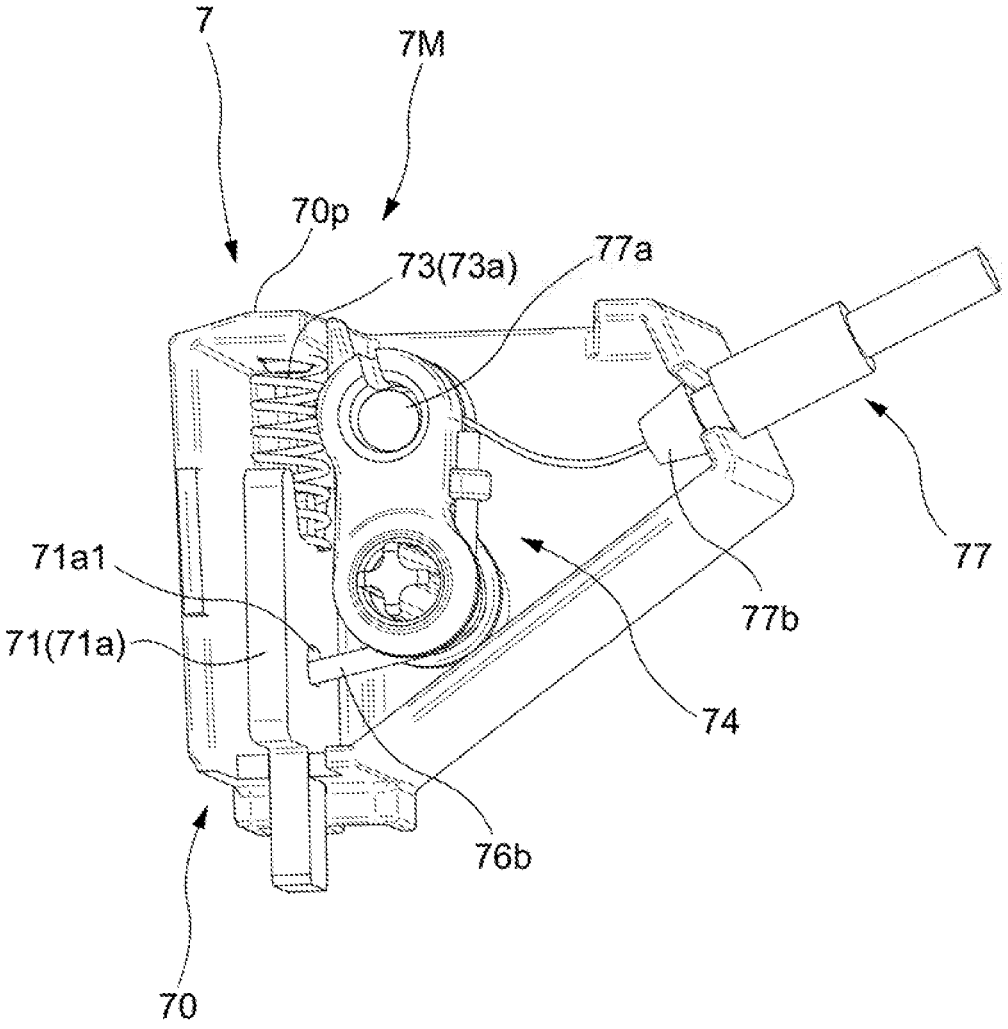
FIG. 20 is a perspective view of a partially assembled left-right stopper mechanism configured to suppress a left-right operation.
Figure 21A:
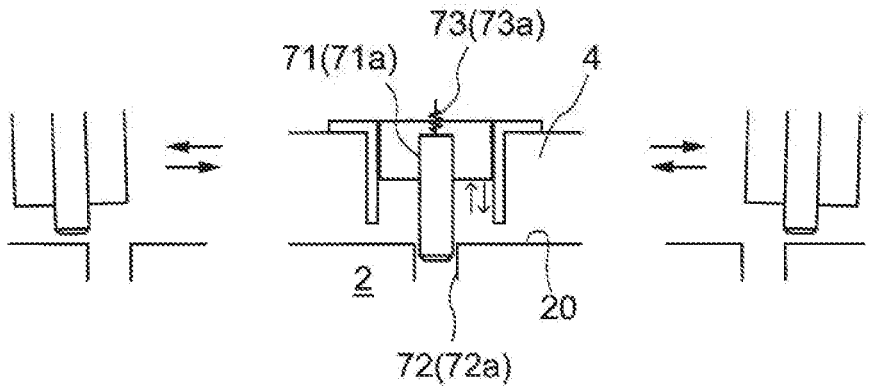
FIGS. 21A to 21C are schematic views illustrating suppressing operations for the front, rear, right, or left.

The left-right stopper mechanism 7M is configured to switch between allowing and suppressing the swinging of the seat 5 in the left-right direction, by engaging or disengaging an engaging part 71 and an engaged part 72 illustrated FIG. 21A when the operating member 151 illustrated in FIG. 15 is operated. Specifically, the left-right stopper mechanism 7M includes an engagement pin 71*a* being the engaging part 71 provided at the side of the left-right swing part 4 and a groove 72*a* being the engaged part 72 provided on a sliding surface 20, the engaged part 72 relatively operating at the side of the support base part 2 being a position facing the engagement pin 71*a*. The engagement pin 71*a* is configured to be elastically biased toward the sliding surface 20, and to be fitted in the groove 72*a* at a predetermined position. As illustrated in FIGS. 3 and 7, the groove 72*a* has a rectangular shape in plan view and is provided at a center reference position in the left-right direction of the support base part 2 exposed upward via an opening 4*t* of the left-right swing part 4, and the engagement pin 71*a* illustrated in FIG. 20 is engaged to and disengaged from the groove 72*a*. A coil spring 73*a* being an elastic member 73 functions to bias the engagement pin 71*a* in a direction where the engagement pin 71*a* protrudes toward the sliding surface 20. Further, the left-right stopper mechanism 7M includes a conversion mechanism 74 illustrated in FIGS. 19 and 20 configured to convert an operation of the operating member 151 into an operation in a direction in which the engagement pin 71*a* is separated from the sliding surface 20 and the conversion mechanism 74, the engagement pin 71*a* and the coil spring 73*a* are integrally incorporated into a casing 70 of the left-right lock unit 7 to form with unitized.

Figure 19:
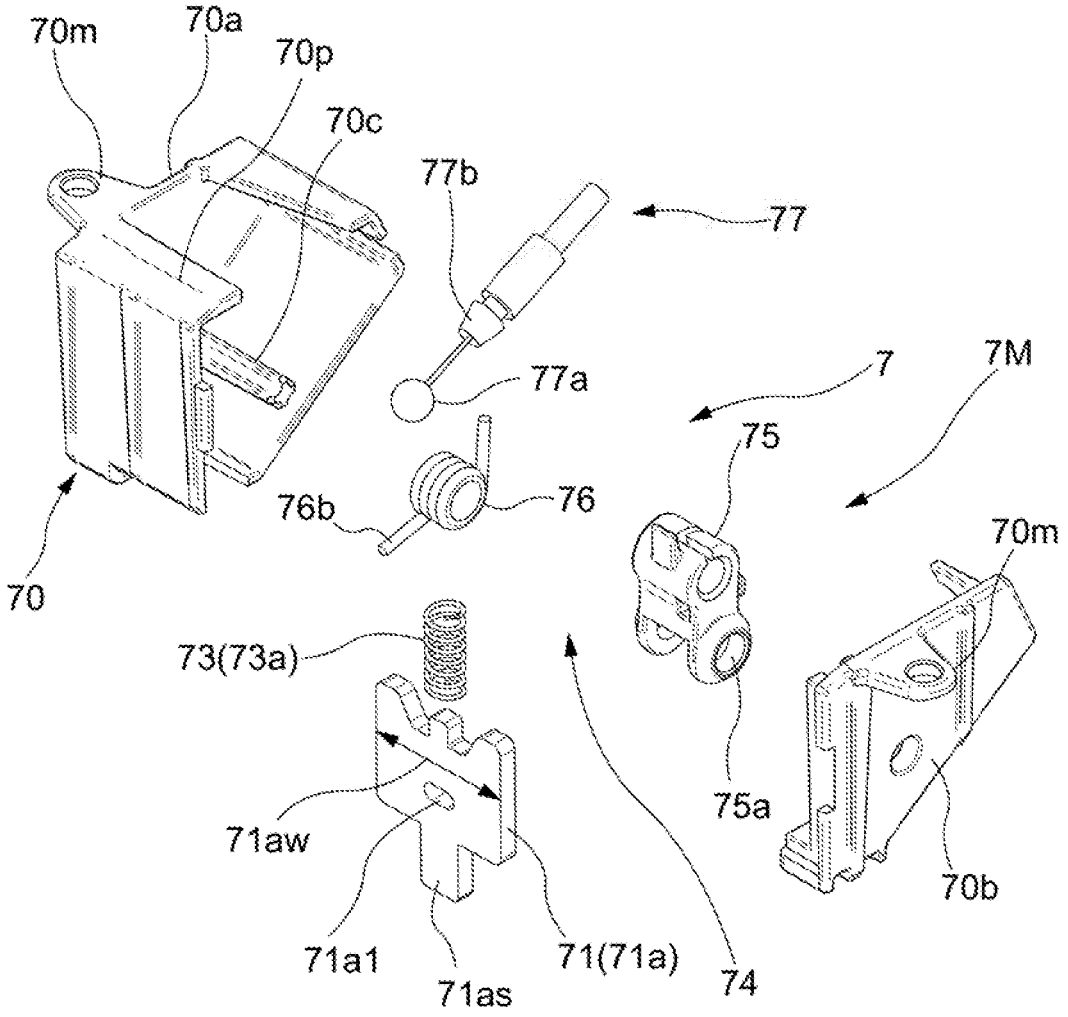
FIG. 19 is an exploded perspective view of a left-right stopper mechanism configured to suppress a left-right operation.

As illustrated in FIG. 19, the casing 70 has a halved structure, and the engagement pin 71*a* is disposed to be liftable and lowerable in a state where a wide part 71*aw* of the engagement pin 71*a* is guided by inner surfaces of side walls 70*a*, 70*b* of the casing 70 while a tip end part 71 as being a part of the engagement pin 71*a* protrudes from a lower end of the casing 70. The conversion mechanism 74 includes the above-described coil spring 73*a* provided elastically in a compressed state between an upper end of the engagement pin 71*a* and an upper wall 70*p* of the casing 70, a stopper operation arm 75 rotatably supported via a horizontal shaft 70*c* between the side walls 70*a*, 70*b* of the casing 70 at a position adjacent to the engagement pin 71*a*, a torsion coil spring 76 rotatably attached together with the stopper operation arm 75, and a wire tube 77 including a spherical wire tip end 77*a* to be attached to the stopper operation arm 75 and a tube tip end 77*b* locked to the casing 70. As illustrated in FIG. 15, the other end of the wire tube 77 is locked in the vicinity of an operation lever 151*a* being the operating member 151 provided in the seat 5 and a wire base end 77*c* drawn therefrom is connected to the operation lever 151*a*. A tip end 76*b* of the torsion coil spring 76 is engaged with a hole 71*a*1 provided on the engagement pin 71*a*.

When the casing 70 is fitted into the unit attached hole 42*a* of a swing main body part 42 included in the left-right swing part 4 illustrated in FIG. 7 to achieve the state in FIG. 8, an attachment part 70*m* provided in the casing 70 is mounted on an upper surface of the swing main body part 42 and fixed by screwing. The left and right side walls 70*a*, 70*b* of the casing 70 are tightly accommodated between left and right side walls 42*a*1, 42*a*2 of the unit attached hole 42*a* and the engagement pin 71*a* is tightly guided in the casing 70 by the inner surfaces of the side walls 70*a*, 70*b* of the casing 70. In this way, a rattling of the engagement pin 71*a* to the left and right is suppressed, and thus, the unit attached hole 42*a* of a left-right swing part 4 illustrated in FIG. 7 includes merely the left and right side walls 42*a*1, 42*a*2, a rear wall 42*a*3, and an inclined front wall 42*a*4 to form the lower opening 4*t* without a bottom wall. The engagement pin 71*a* is configured to hang directly from the lower opening 4*t* of the unit attached hole 42*a* without being guided by the bottom wall to abut against the sliding surface 20, to engage with the groove 72*a*. Parts in the front-rear direction of the engagement pin 71*a* are supported by front and rear guide walls formed in the casing 70. The groove 72*a* is formed between longitudinal ribs r1, r1 provided in the support base part 2, lateral ribs r2 are provided around the longitudinal ribs r1, r1, and upper surfaces of the longitudinal ribs r1 and the lateral ribs r2 form the sliding surface 20 on which the engagement pin 71*a* slides until engaging with the groove 72*a*.

Figure 22:
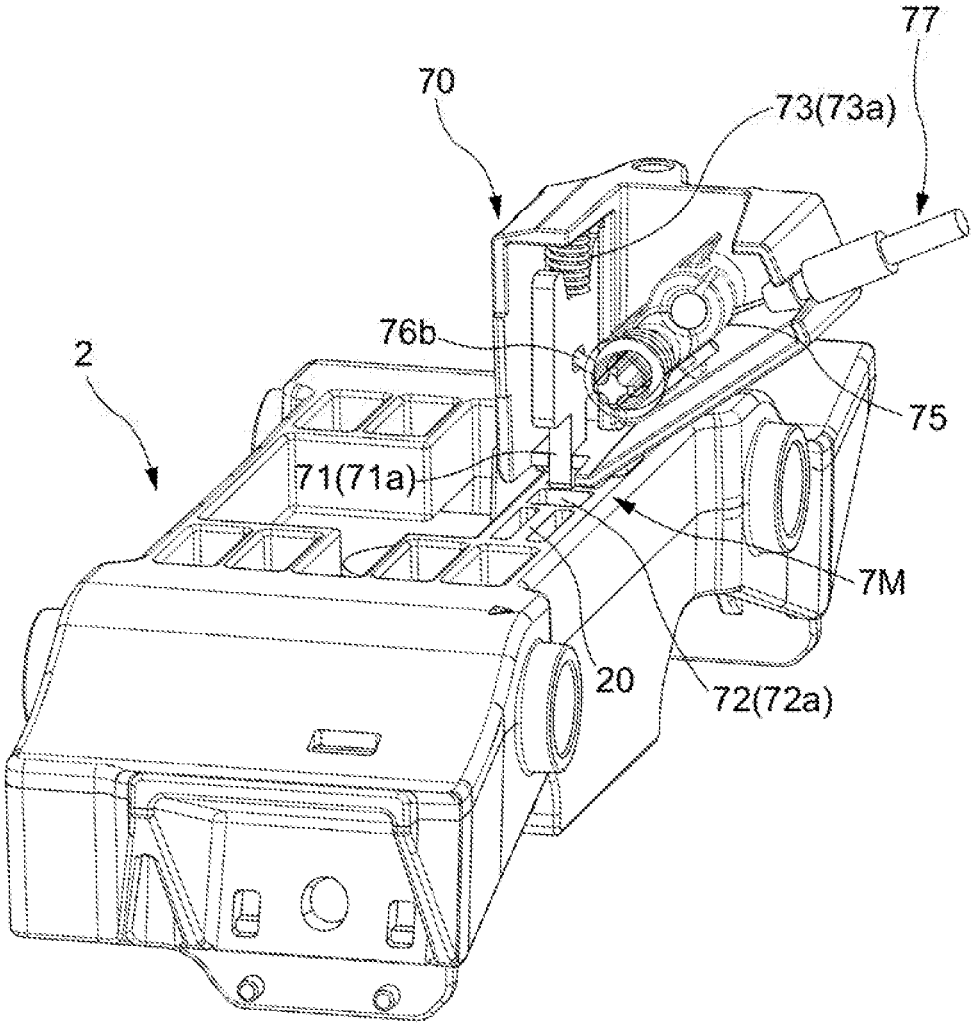
FIG. 22 is an operation explanatory diagram of the left-right stopper mechanism.
Figure 23:
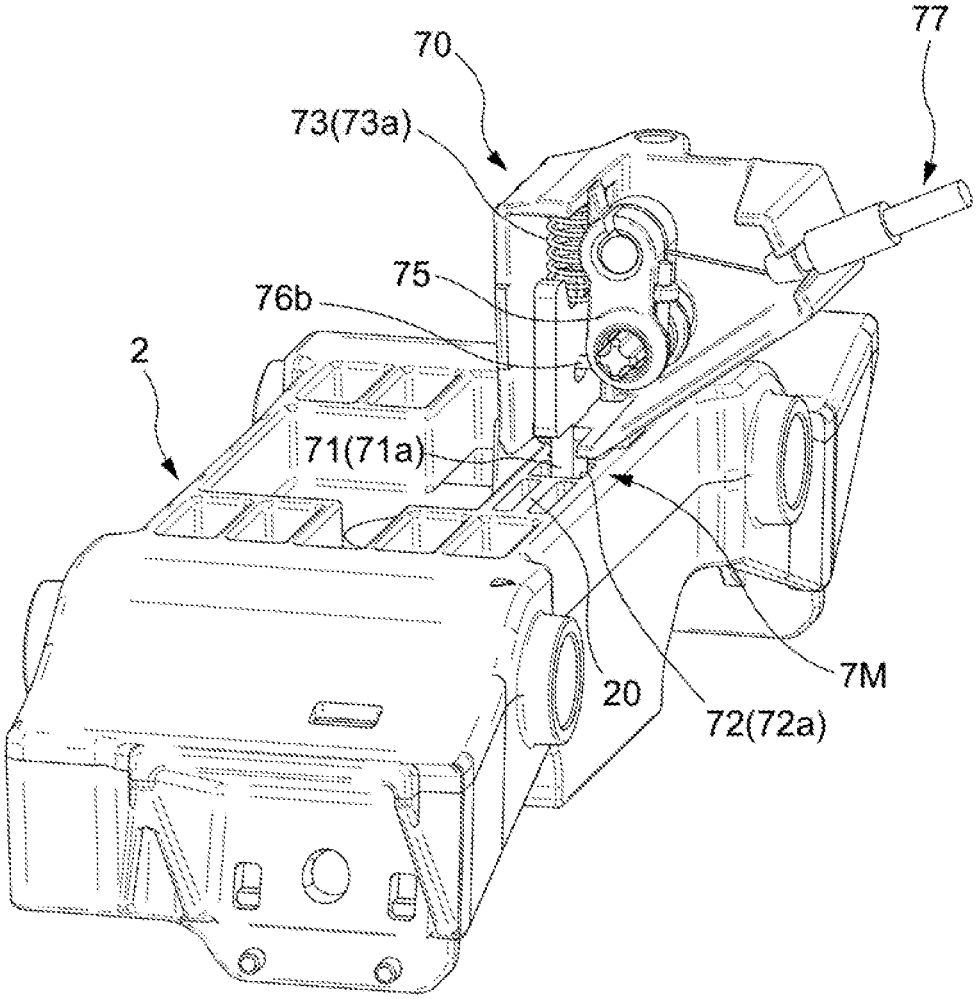
FIG. 23 is an operation explanatory diagram of the left-right stopper mechanism.

As illustrated in FIG. 22, when the operation lever 151*a* is in an unlocked position, the wire tube 77 rotates the stopper operation arm 75 to compress the coil spring 73*a* while the engagement pin 71*a* is lifted upwards at a tip end 76*b* of the torsion coil spring 76. When the operation lever 151*a* is operated to a locked position, as illustrated in FIG. 23, the tip end 76*b* of the torsion coil spring 76 rotates together with the stopper operation arm 75 by the repulsive force of the coil spring 73*a*, the engagement pin 71*a* is pressed downward, and when the engagement pin 71*a* engages with the groove 72*a* of the support base part 2, the locked state in the left-right direction is realized.

Figure 21B:
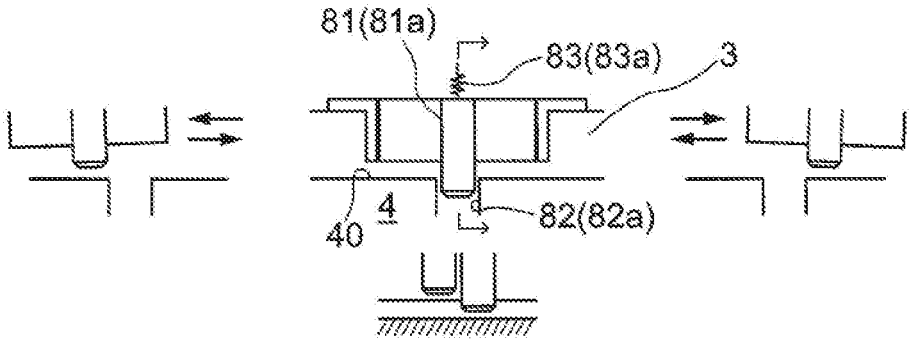

The front-rear stopper mechanism 8M is configured to switch between allowing and suppressing the swinging of the seat 5 in the front-rear direction, by engaging or disengaging an engaging part 81 and an engaged part 82 illustrated in FIG. 21B when the operating member 152 illustrated in FIG. 15 is operated. Specifically, a configuration is so that the front-rear stopper mechanism 8M includes an engagement pin Sla being the engaging part 81 provided at the side of the front-rear swing part 3 and a groove 82*a* being the engaged part 82 provided on a sliding surface 40, the engaged part 82 relatively operating at the side of the left-right swing part 4 being a position facing the engagement pin 81*a*. The engagement pin 81*a* is configured to be elastically biased toward the sliding surface 40, and to fit in the groove 82*a* at a predetermined position. As illustrated in FIG. 7, the groove 82*a* is provided on an upper surface of the swing main body part 42 of the left-right swing part 4 at one or more predetermined locations (one location in the present embodiment) within a movable range of the engagement pin 81*a* when the engagement pin 81*a* of the front-rear swing part 3 mounted on the upper surface of the swing main body part 42 moves in the front-rear direction, and thus, the groove 82*a* has a shape extending in the left-right direction and an upper surface of a swing main body part 42 forms the sliding surface 40. A coil spring 83*a* being an elastic member 83 functions to bias the engagement pin 81*a* in a direction where the engagement pin 81*a* protrudes toward the sliding surface 40, a conversion mechanism 84 illustrated in FIGS. 16 and 17 is provided, the conversion mechanism 84 converting an operation of the operating member 152 into an operation in a direction in which the engagement pin 81*a* is separated from the sliding surface 40, and the conversion mechanism 84, the engagement pin 81*a*, and the coil spring 83*a* are integrally incorporated into a half-piece of the casing 80 to form with unitized The casing 80 has a flat saucer-shape opened upward, and thus, the engagement pin 81*a* is guided by a guide 80*g*1 in the casing 80, and is disposed to be liftable and lowerable with a part of the engagement pin 81*a* protruding from a lower end of the casing 80. The conversion mechanism 84 includes the above-described coil spring 83*a* provided elastically in a compressed state between an upper end of the engagement pin 81*a* and a cover 80*a* closing the upper opening of the casing 80, a stopper operation arm 85 rotatably supported by a horizontal shaft 80*c* disposed between side walls 80*b*, 80*b* of the casing 80 at a position adjacent to the engagement pin 81*a*, a torsion coil spring 86 rotatably attached together with the stopper operation arm 85, and a wire tube 87 having a spherical wire tip end 87*a* that is attached to the stopper operation arm 85 and a tube tip end 87*b* locked to the casing 80. As illustrated in FIG. 15, the other end of the wire tube 87 is locked in the vicinity of an operation lever 152*a* being the operating member 152 provided in the seat 5 and a wire base end 87*c* drawn therefrom is connected to the operation lever 152*a*. A tip end 86*a* of the torsion coil spring 86 is at all times smoothly slidably engaged with a downward-facing surface 81*a*1 of the engagement pin 81*a*.

Figure 24:
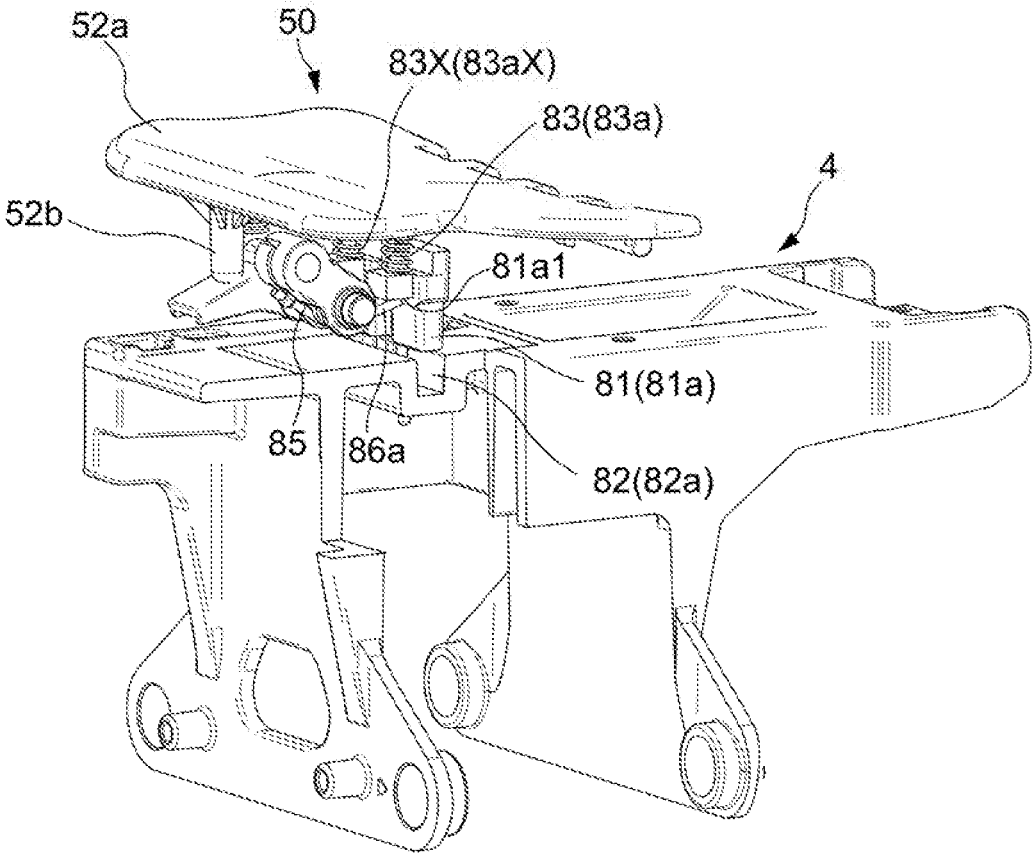
FIG. 24 is an operation explanatory diagram of the front-rear stopper mechanism.
Figure 25:
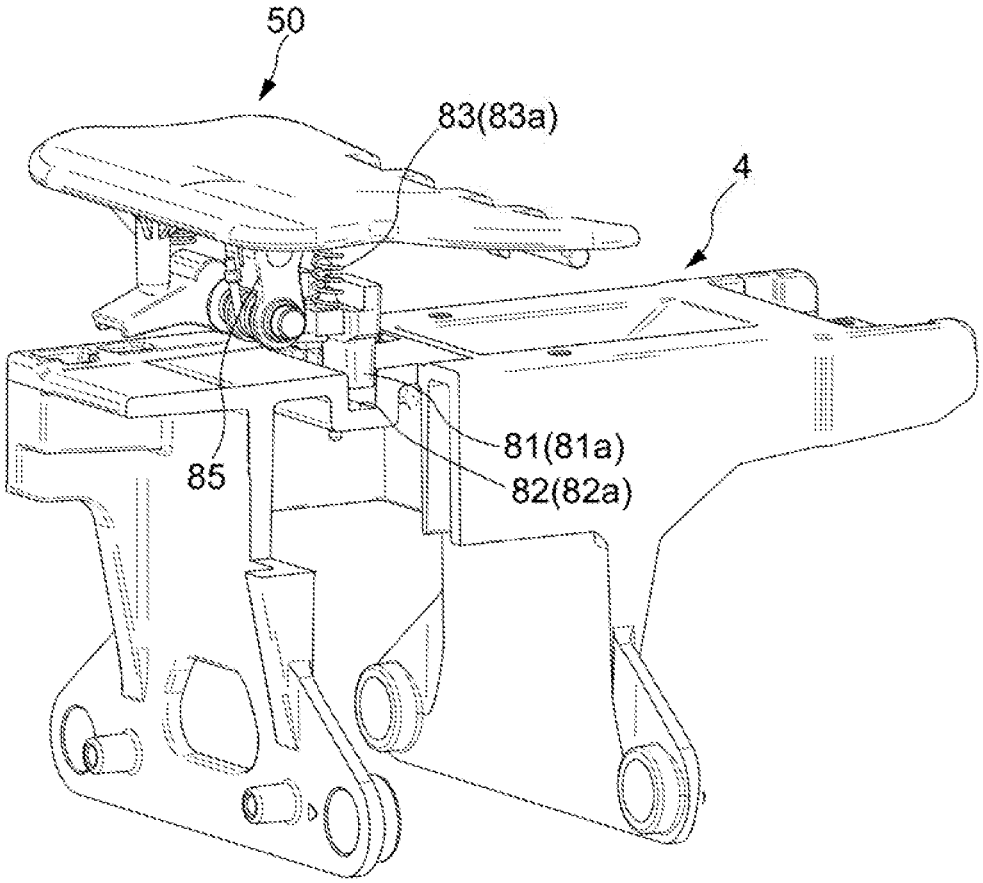
FIG. 25 is an operation explanatory diagram of the front-rear stopper mechanism.

When the operation lever 152*a* illustrated in FIG. 15 is in an unlocked position, the wire tube 87 illustrated in FIG. 17 rotates the stopper operation arm 85 to compress the coil spring 83*a* while the engagement pin 81*a* is lifted upwards at a tip end 86*a* of the torsion coil spring 86, as illustrated in FIG. 24. When the operation lever 152*a* is operated to a locked position, the tip end 86*a* of the torsion coil spring 86 rotates, as illustrated in FIG. 25, together with the stopper operation arm 85 by the repulsive force of the coil spring 83*a*, the engagement pin 81*a* is pressed downward, and when the engagement pin 81*a* engages with the groove 82*a* of the left-right swing part 4, the locked state in the front-rear direction is realized.

It is noted that, in the chair according to the embodiment, a control mechanism 8X configured to automatically suppress a movement of the seat 5 in the front-rear direction at a predetermined position when the seated person leaves the seat, is provided along with the half-piece of the front-rear lock unit 8 of the front-rear stopper mechanism 8M.

First, to detect seating of the seated person, a configuration is such that a weight-receiving part 50 (see FIG. 15), the height position of which changes due to a person sitting on a seat surface, is provided substantially at a center position of the seat 5, the change of the height position is mechanically transmitted to the control mechanism 8X illustrated in FIGS. 16 and 18 configured to control an operation of the front-rear swing part 3 being the movable part, and the control mechanism 8X changes the operation of the front-rear swing part 3, that is, the front-rear operation of the seat 5, between allowed and suppressed states.

Figure 21C:
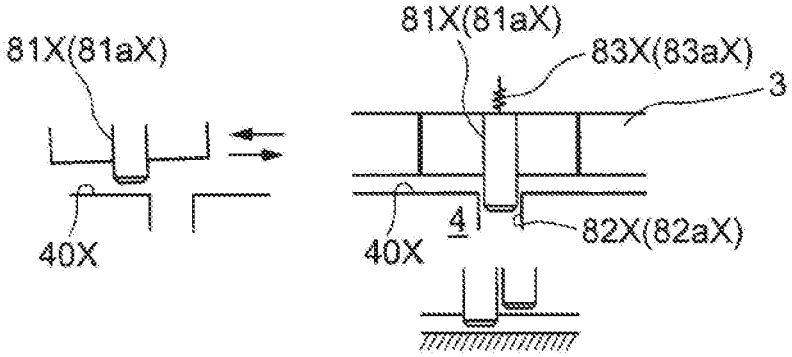

The control mechanism 8X changes the allowed/suppressed states of the operation of the front-rear swing part 3 when an engagement state of an engaging part 81X illustrated in FIG. 21C and provided in the front-rear swing part 3 being a movable part and an engaged part 82X provided in the left-right swing part 4 being a support part configured to support the front-rear swing part 3 changes due to the load applied by seated person, and returns, by the elastic member 83X, the state of the front-rear swing part 3 from an operation state where the operation of the front-rear swing part 3 is allowed to the original state where the operation of the front-rear swing part 3 is suppressed, if the load applied by seated person is removed.

The chair is configured such that the engaged part 82X is a recess 82*a*X, and when the load applied by seated person is received in the state where the engaging part 81X is fitted into the recess 82*a*X, the fitted state is released, so that the engaging part 81X and the engaged part 82X are disengaged due to the load applied by seated person, and when the load applied by seated person is removed, the engaging part 81X and the engaged part 82X engage with each other by the elastic force to bring the front-rear swing part 3 into an operation-suppression state.

The control mechanism 8X includes an engagement pin 81*a*X being the engaging part 81X, and a groove-shaped recess 82*a*X being an engaged part 82X provided on a sliding surface 40X relatively operating at a position facing the engagement pin 81X. The engagement pin 81*a*X is configured to be elastically biased toward the sliding surface 40X, and to fit in the groove-shaped recess 82*a*X at a predetermined position. Then, when the seat 5 detects received of the load applied by seated person in the central part, the control mechanism 8X illustrated in FIGS. 16 and 17 separates the engagement pin 81*a*X from the groove-shaped recess 82*a*X. A coil spring 83*a*X being an elastic member 83X functions to bias the engagement pin 81*a*X in a direction where the engagement pin 81*a*X protrudes toward the sliding surface 40X. The control mechanism 8X includes a conversion mechanism 84X configured to convert an operation of the weight-receiving part 50 due to a person sitting on the seat, into an operation in a direction where the engagement pin 81*a*X is separated from the sliding surface 40X, and the conversion mechanism 84X, the engagement pin 81*a*X, and the coil spring 83*a*X are integrally incorporated into an other-half part of the casing 80 illustrated in FIG. 16, to form with unitized.

Figure 37:
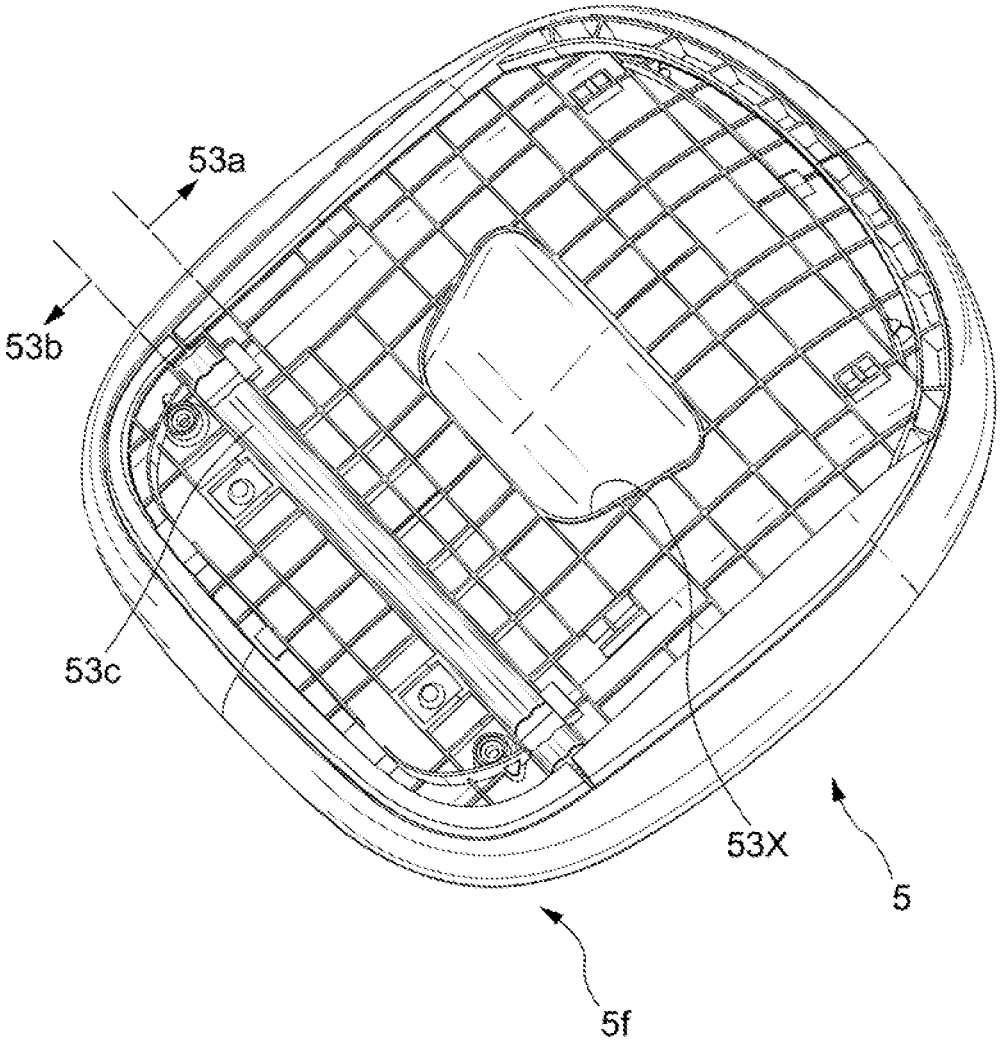
FIG. 37 is a perspective view illustrating a lower surface of the seat.

The engagement pin 81*a*X is disposed to be 1 liftable and lowerable along front, rear, right, or left guides 80*g*2 of the casing 80, in a parallel relationship with the engagement pin 81 in the flat casing 80 configuring the front-rear stopper mechanism 8M. Similarly in parts to the conversion mechanism 84, the conversion mechanism 84X includes the coil spring 83*a*X provided elastically in a compressed state between an upper end of the engagement pin 81*a*X and the cover 80*a* closing the upper opening of the casing 80, a safety operation arm 85X rotatably supported by the horizontal shaft 80*c* disposed between side walls 80*b*, 80*b* of the casing 80 at a position adjacent to the engagement pin 81*a*X, and a torsion coil spring 86X rotatably attached together with the safety operation arm 85X. On the other hand, the weight-receiver 50 is, as illustrated in FIG. 15, a pressure-receiving plate 52*a* rotatably fitted and attached to the seat outer shell 51 included in the seat 5, and a convex part 52*b* provided below the pressure-receiving plate 52*a* is disposed at a position displaced from the center of rotation of the safety operation arm 85X, where the convex part 52*b* can press a pressed part 85*xt* illustrated in FIG. 16. A tip end 86*a*X of the torsion coil spring 86X is at all times smoothly slidably engaged with a downward-facing surface of the engagement pin 81*a*X. The pressure-receiving plate 52*a* is biased in a direction away from the safety operation arm 85X by a coil spring 52*c* being an elastic body illustrated in FIG. 26. As illustrated in FIG. 37, a hole part 53*x* configured to avoid interference with the pressure-receiving plate 52*a* is provided at a corresponding position of a seat inner shell 53.

Figure 26A:
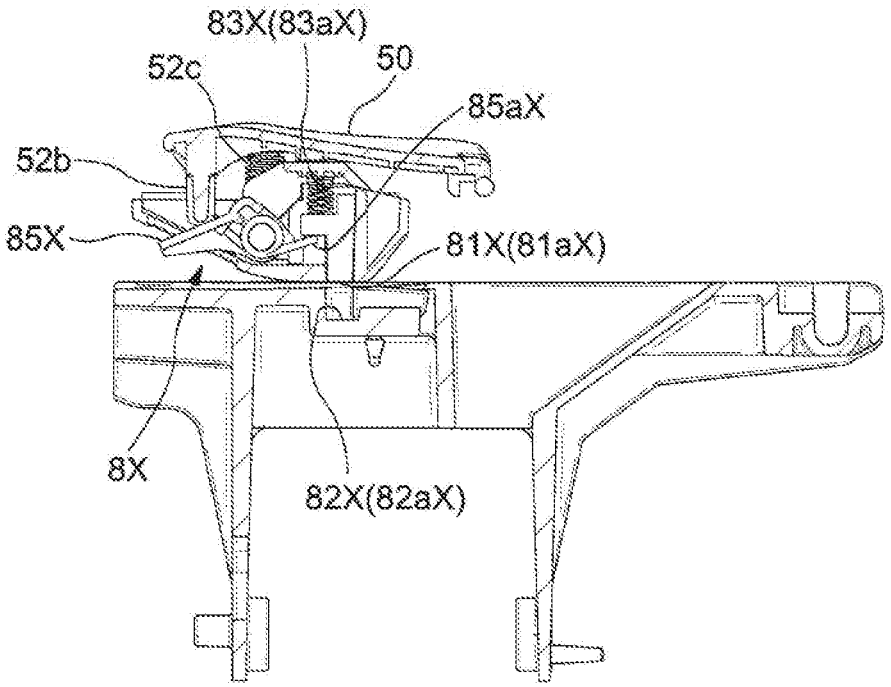
FIGS. 26A and 26B are operation explanatory diagrams of a control mechanism operating in accordance with a seating state.
Figure 26B:
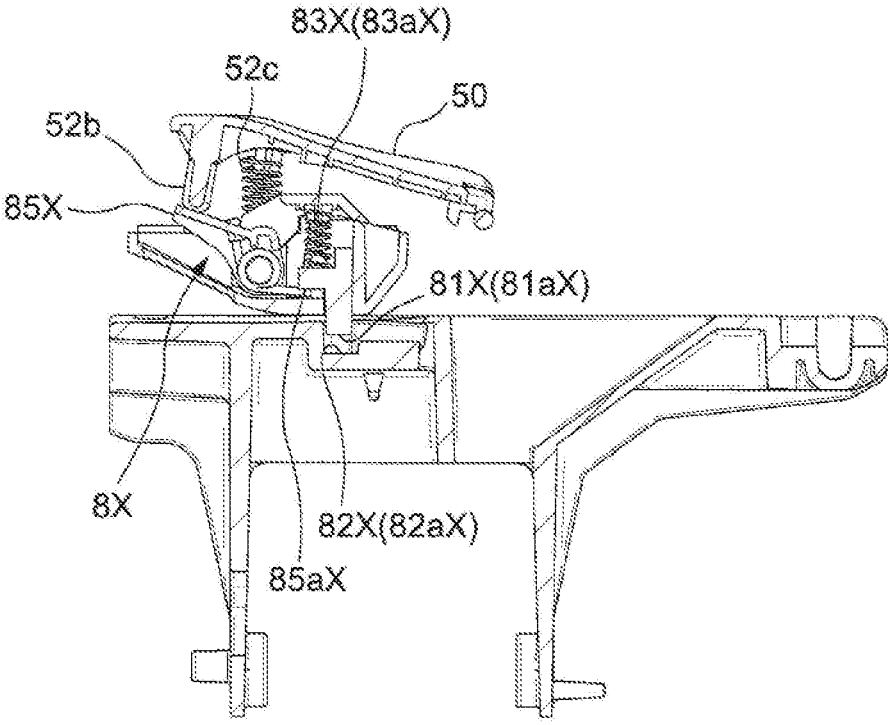

As illustrated in FIG. 26B, when the weight-receiving part 50 does not sense the weight of the seated person, the engagement pin 81X is pressed downward by the coil spring 83*a*X while a tip end 85*a*X of a torsion coil spring 86X rotates together with the safety operation arm 85X, and when the engagement pin 81X engages with a groove 82*a*X of the front-rear swing part 3 the locked state in the front-rear direction is realized. As illustrated in FIG. 26A, when the weight-receiving part 50 detects the weight of the seated person, when the engagement pin 81X is pulled upward at the tip end 86*a*X of the torsion coil spring 86X while compressing the coil spring 83*a*X, the engagement pin 81X is disengaged from the groove-shaped recess 82*a*X and the locked state in the front-rear direction is released.

That is, when a user is seated, the control mechanism 8X is unlocked, and afterwards, whether or not the seated person locks a movement in the front-rear direction depends on the state of a front-rear fixing stopper mechanism 8M, via the operation of the operating member 152, and when the seated person leaves the seat, the state is maintained unless the front-rear fixing stopper mechanism 8M is unlocked, and if the front-rear fixing stopper mechanism 8M is unlocked, the control mechanism 8X actuates to lock the front-rear operation of the seat 5.

In particular, in this chair, the seat 5 tilts at least back and forth, and when the seated person starts standing up, the seat 5 moves while tilting forward together with the front-rear swing part 3, as illustrated in FIG. 13. When the seated person leaves the seat in this state and the load applied by seated person is removed, the engagement pin 81*a*X being the engaging part 81X illustrated in FIG. 21C settles on the sliding surface 40X in the front of the recess 82*a*X being the engaged part 82X. Afterwards, the seat 5 starts moving while tilting rearward in accordance with a relationship of the center-of-gravity position between the back and the seat, due to the presence of the back 6. During this movement, it is expected that the engagement pin 81*a*X being the engaging part 81X engages with the recess 82*a*X being the engaged part 82X. As illustrated in FIG. 7, in the recess 82*a*X, grooves are provided in a linked manner in an orthogonal direction, and a buffer material 82*z* such as rubber is embedded. The buffer material 82*z* is for avoiding collision of the engagement pin 81*a*X with the wall of the recess 82*a*X a shock or an abnormal noise caused, and after colliding with the buffer material 82*z*. The engagement pin 81*a*X collides with the buffer material 82*z* and fitted into the recess 82*a*X.

It is noted that, when a person sits on the seat, the engagement pin 81*a*X and the recess 82*a*X are disengaged, however, the engagement pin 81*a*X and the c recess 82*a*X engage with a certain degree of resistance, and thus, the locked state is not released immediately after the person sits on the seat, but is released when the resistance decreases due to a small movement of the seat 5.

That is, the control mechanism 8X switches the locked state of the seat 5 between when the seated person leaves the seat and when sitting on the seat, and thus, may be called a "seat-leaving and seat-sitting automatic stopper mechanism".

Next, the guide hole 34 illustrated in FIG. 3 will be described. Even if the rail plate 31 being a plate member PM is thickened or a separate member is attached to the rail plate 31 to provide the guide hole 34 for securing a pressure-receiving area, this may only lead to an increase in the number of parts and the cost and does not necessarily lead to improvement of strength and durability.

Therefore, in the present embodiment, as illustrated in FIG. 27, a flange part 31*b* is provided on the plate member PM of the front-rear swing part 3 being the movable portion in which the guide hole 34 is provided, that is, on a vertical surface 31*a* of the rail plate 31, and a guide surface 31*b*1 for moving the bearing 45*a* being the rolling body 45 in the longitudinal direction is provided at a position extending in the lateral direction of the flange part 31*b*, that is, in the horizontal direction in the attached state.

A lateral dimension w1 of the guide surface 31*b*1 is greater than a thickness t1 of the rail plate 31 being the plate member PM. The guide surface 31*b*1 is integrally formed of metal together with the rail plate 31. As illustrated in FIG. 3 and the like, the flange part 31*b* has a shape that goes around the circumference of the guide hole 34 opened in the vertical surface.

The flange part 31*b* according to this embodiment is configured by plastic deformation processing of the plate member PM around the guide hole 34, and specifically, by adopting burring processing. In general, in the burring processing, a pilot hole is opened in a plate member, the periphery of the pilot hole is fixed with a jig and in this state, the edge of the pilot hole is raised, by pressing with a tool larger than the pilot hole, to form a flange part, and thus, a cylindrical flange is generally formed. So far, burring processing has only been utilized for forming tapped holes and the like and has not been considered for producing a structure for guiding a rolling body.

Figure 28A:
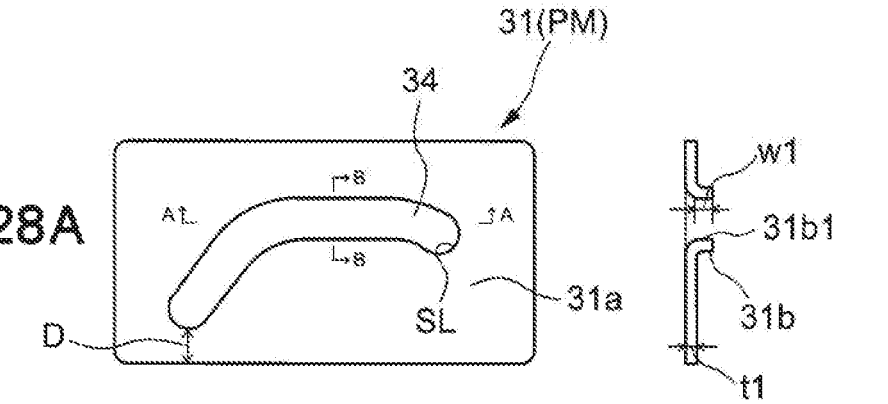
FIGS. 28A to 28C are diagrams for explaining a processing procedure of the guide hole.
Figure 28B:
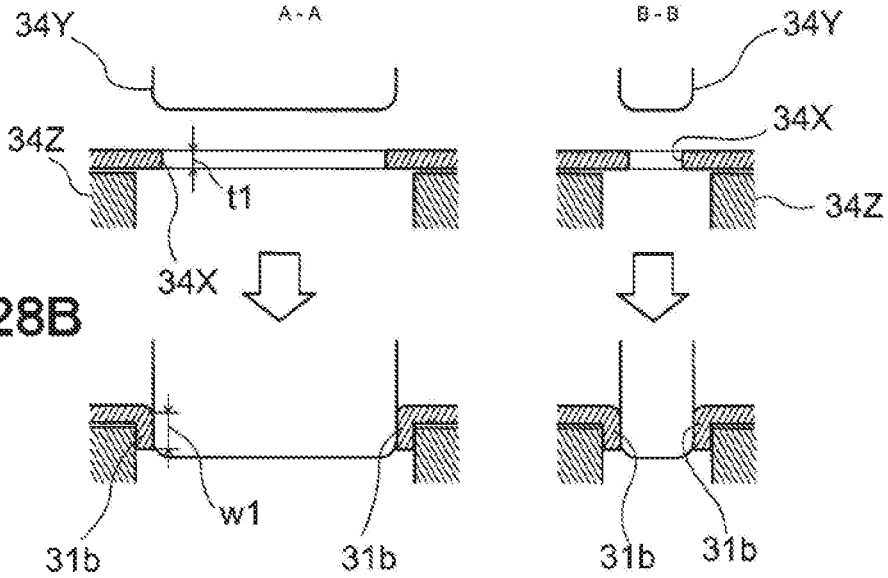

Therefore, in the present embodiment, based on this new perspective, as illustrated in FIG. 28A, to form an asymmetrical hole, or more specifically, the guide hole 34 extending with a substantially constant width, a pilot hole 34*x* corresponding to the shape of the guide hole 34 is opened with a slightly smaller size than the guide hole 34, as illustrated in FIG. 28B. Then, the periphery of the pilot hole 34*x* is fixed with a jig 34Z along the shape of the guide hole 34, and in this state, pressing is performed with a tool 34Y that is larger than the pilot hole 34*x* and corresponds to the inner circumferential shape of the guide hole 34. Thus, as illustrated in FIG. 27, the flange part 31*b* extending in the lateral direction via a portion R from the vertical surface 31*a* is formed over the entire circumference of the guide hole 34, and the flange part 31*b* directed in this lateral direction is substantially the pressure-receiving area. The lateral dimension of the guide surface 31*b*1 is substantially uniform over the entire circumference.

The manufacturing means for the guide hole 34 is selected based on the conditions that the guide surface 31*b*1 is smooth, the guide surface 31*b*1 has strength, and the manufacturing cost is low. Fine blanking processing and other processing were also tried, however, it turned out that, even though the fine blanking processing relatively likely to be selected was excellent in forming a smooth guide surface, the plate member needed to have a considerable thickness to obtain strength. Thus, the fine blanking processing could not be adopted due to its inappropriate cost and other processing also did not satisfy the conditions above. Overall, it turned out that burring processing met these conditions very suitably.

However, when a shortest distance D from the guide hole 34 to the nearest edge of the plate member PM is narrow in the burring processing, the plate member PM is deformed during the processing or due to the load applied during the processing. As a result of attempting various tests in this embodiment, it was found that it was necessary and sufficient, as a condition for obtaining a stable shape, to set the shortest distance D (see FIG. 28) from the guide hole 34 to the edge of the plate member PM at an appropriate position to at least 15 mm or more for 2 to 6 mm of a thin plate.

As illustrated in FIG. 27, when viewing the entire chair, the flange part 31*b* formed in this way extends outward from the pair of rail plates 31, 31, rather than inward in the left-right direction, and the guide surface 31*b*1 being a rolling surface is formed outside the rail plates 31. Further, to mitigate a shock caused from a collision with the bearing 45*a* being the rolling body 45, one end (the front end or the rear end) of the guide hole 34 is formed with a so-called shockless part in which the radius of curvature is changed, so that as the bearing 45*a* approaches the end due to an operation of the seat 5, the operation speed of the seat 5 is reduced by performing control so that the center of gravity of the seat 5 is lifted. The flange part 31*b*1 made by burring is designed to withstand the shock caused during this time.

Further, when a left-right support state of the front-rear swing part 3 for the left-right swing part 4 becomes unbalanced, a lower region of the guide hole 34 causes the bearing 45*a* being the rolling body 45 to abut against the lower region of the guide hole 34 to support the bearing 45*a* and the flange part 31*b* contributes to supporting the load during this time.

Figure 28C:
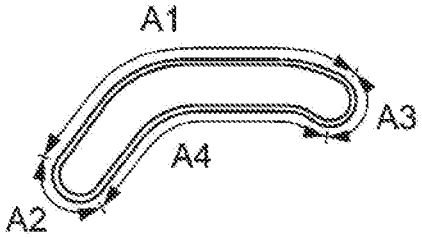

Generally speaking, as illustrated in FIG. 28C, the flange part 31*b* includes an upper-side first flange area A1 supporting the back and forth movement of the bearing 45*a* being the rolling body 45 when the seat 5 operates back and forth, a front-side second flange area A2 supporting a portion where the bearing 45*a* being the rolling body 45 reaches the front end of the guide hole 34 when the seated person leans against the back 6, and a rear-side third flange area A3 supporting a portion where the bearing 45*a* being the rolling body 45 reaches the rear end of the guide hole 34 when the seated person leans forward. Further, the flange part 31*b* includes a lower-side fourth flange area A4 supporting the bearing 45*a* being the rolling body 45 when the left-right support state is unbalanced. This structure remains similar, even if the guide hole 34 is formed at the side of the support portion and the bearing 45*a* being the rolling body 45 is disposed at the side of the movable portion.

As described above, the guide hole 34 is formed in the vertical surface of movable portion or the support portion of the chair and moves while receiving the load applied by seated person. The movable portion is supported at two locations on the front and rear side by the support portion including a guide structure configured by the rolling body 45 and the guide hole 34. In the present embodiment, the other movable portion of the chair is supported by the link arm LA, any one of the front and rear support structures is configured by the above-described rolling body 45 and the guide surface 31*b*1, and the other is configured by a different support structure, that is, in this embodiment, of the link structure.

Next, the support mechanism of the back 6 will be described. As illustrated in FIGS. 2, 14, 30, and 29, in this chair, the back 6 is arranged behind the seat 5 and the backrest 62 is configured to be supported by the back frame 61 via the operating mechanism 6M. A back inner cover 63 is attached to the back frame 61, an opening 63*a* is provided in the back inner cover 63, and the backrest 62 is operatively supported by the back frame 61 via the opening 63*a*.

The backrest 62 includes a cushion arranged on the front surface of a back plate 62*a* and the backrest 62 is entirely covered by an upholstery fabric. A lower end of the backrest 62 is disposed at a predetermined distance above the seat surface and the backrest 62 is supported on a back surface side by a back support part 61*a* at an upper end of the back frame 61 via the operating mechanism 6M.

Figure 29:
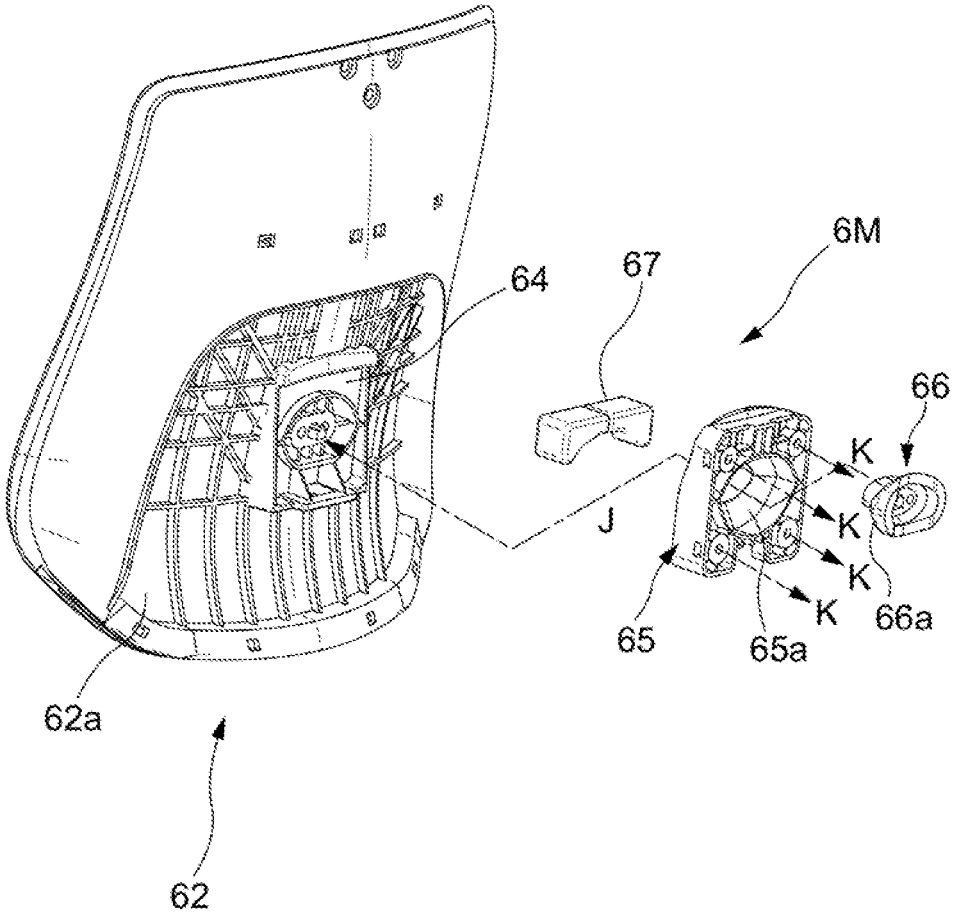
FIG. 29 is an exploded perspective view illustrating an operating mechanism of the back.
Figure 30:
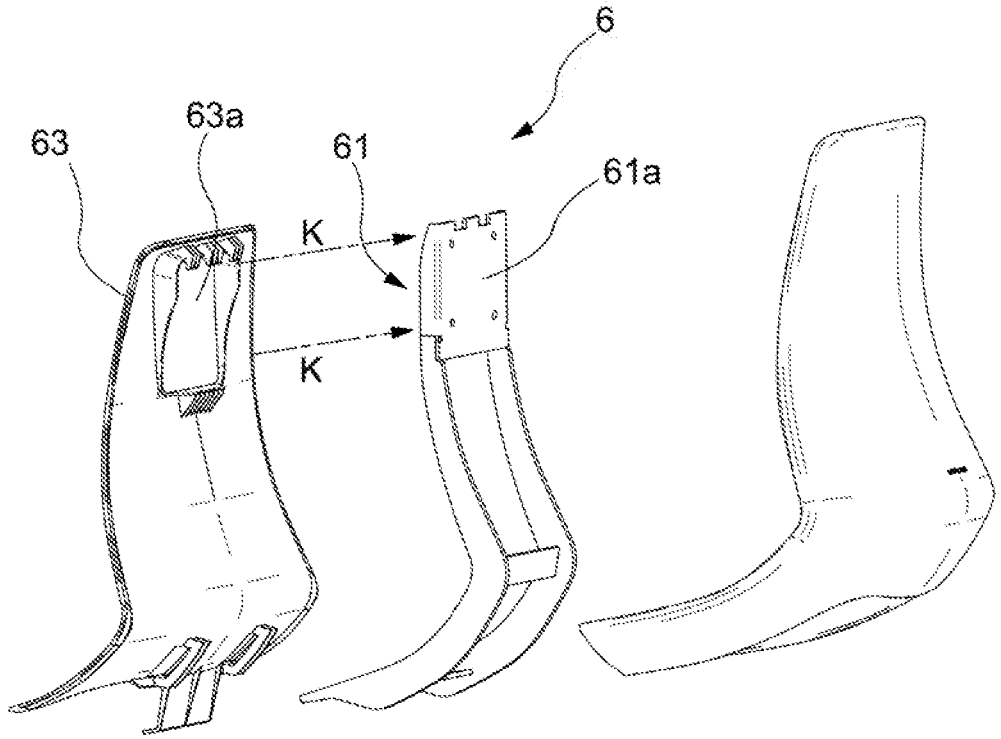
FIG. 30 is an exploded perspective view illustrating a configuration of the back.
Figure 31:
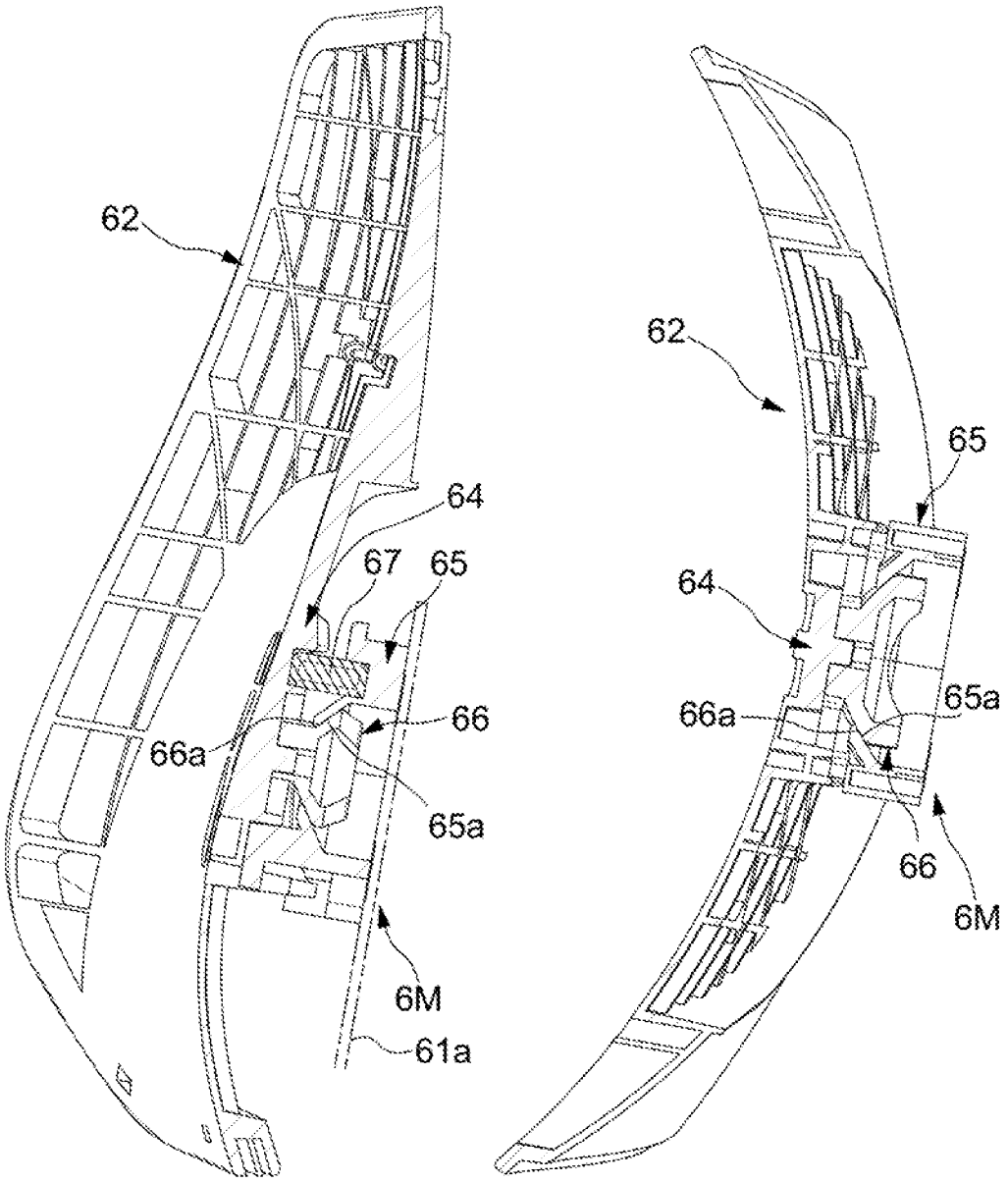
FIG. 31 is a cross-sectional view of the back including the operating mechanism.

The operating mechanism 6M includes: a base part 64 fixed to or formed integrally with the back plate 62*a* included in the backrest 62 and including an elastic body 67 arranged on a back surface side of the base part 64; a tilting part 65 disposed at a position adjacent to the base part 64 and including a guide part 65*a* recessed in a tapered shape at the back surface side, the center of the guide part 65*a* being open in the front-rear direction; and a pressing tool 66 including a convex guide part 66*a* corresponding to the guide part 65*a* on the front surface side, the pressing tool 66 being fixed to the base part 64 via the opening of the tilting part 65 in a state where the guide part 66*a* is fitted into the guide part 65*a*, as illustrated by an arrow J in FIG. 29. As illustrated by arrows K in FIGS. 29 and 30, a configuration of the operating mechanism 6M is such that the tilting part 65 is pulled and passed through the opening of the back inner cover 63 to be fixed by a screw to the back support part 61*a* at the upper end side of the back frame 61. That is, as illustrated in FIG. 31, the pressing tool 66 is fixed to the base part with the tilting part 65 interposed therebetween, and thus, the pressing tool 66 is integrally formed with the base part 64 to form a part of the base part 64. The tilting part 65 can move freely in the gap between the base part 64 and the pressing tool 66, however, a configuration is such to allow for free movement of the tilting part 65, it is necessary to compress an elastic body 67 interposed between the tilting part 65 and the base part 64 against the elastic force. The elastic body 67 exerts a force on the guide part 65*a* of the tilting part 65 in a direction where the guide part 65*a* is constantly fitted in the guide part 66*a* of the pressing tool 66.

Figure 32:
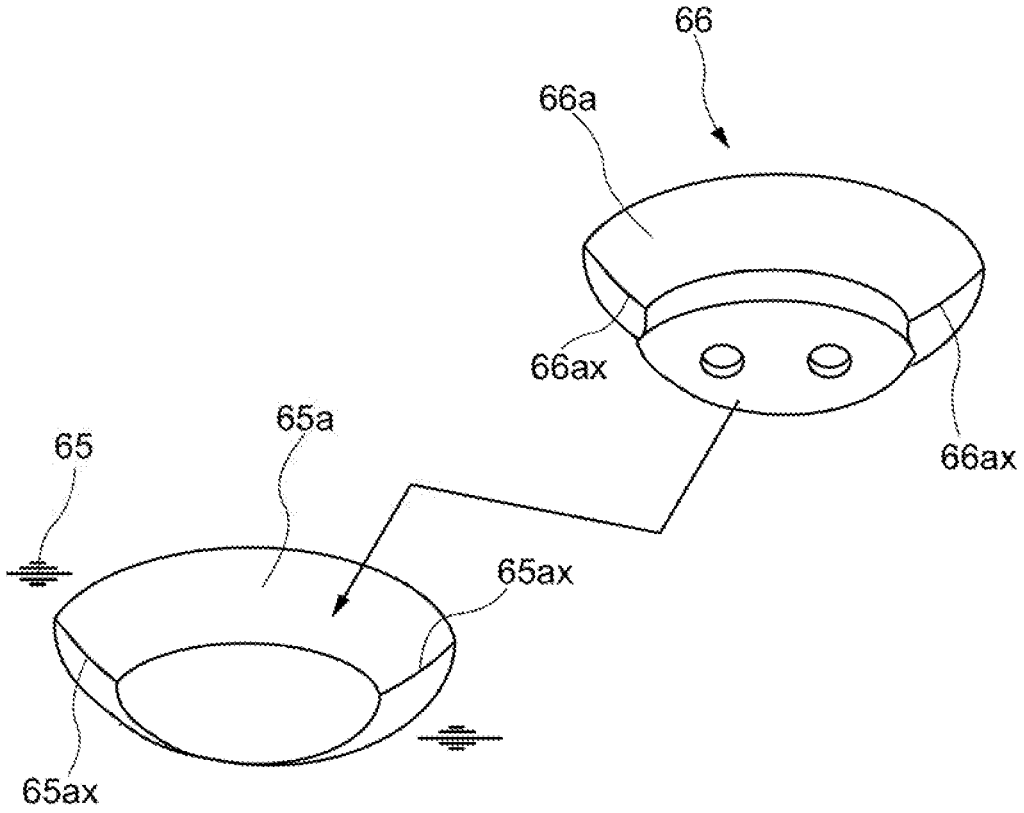
FIG. 32 is an explanatory diagram of a guide part included in the operating mechanism.

More specifically, as illustrated in FIG. 32, the recess guide part 65*a* of the tilting part 65 has a substantially partially elliptical mortar-like shape including at least one valley line 65*ax* (two in this embodiment), the convex guide part 66*a* of the pressing tool 66 has a curved shape having at least one ridge line 66*ax* (two in this embodiment) fitted smoothly into the valley line 65*ax*, and the valley line 65*ax* and the ridge line 66*ax* can be fitted into each other. The convex guide part 66*a* is similar to a shape obtained by eliminating a part of an elliptical sphere, and the ridge line 66*ax* is formed along a line by a guide surface 66*a* intersected on the long axis side of the elliptical sphere. In a corresponding position of the matching recess guide part 65*a*, the valley line 65*ax* is also formed along a line by the intersected guide surface 65*a*. The reason therefore is that a spherical body and a spherical surface-receiving seat do not have directionality and cannot perform a positioning function. In that sense, the convex guide part 66*a* and the recess guide part 65*a* are not limited to the mortar-like shape and the shape of the elliptical sphere, as long as they have different shapes that uniquely determine the directionality during fitting. However, in view of the smoothness of the guides, the guide parts 66*a*, 65*a* need to be configured of a smooth continuous surface. The ridge line 66*ax* and the valley line 65*ax* are provided to enhance the positioning function during fitting.

In this embodiment, urethane is used for the elastic body 67, and as illustrated in FIG. 29, the elastic body 67 is arranged from the left and right corner parts to the upper edge portion of the upper half of the rectangular plate-shaped base part 64. As illustrated in FIG. 31, the thickness dimension of the elastic body 67 is set to achieve an appropriately compressed state in a state where the pressing tool 66 is attached to the base part 64, the tilting part 65 is attached to the back support part 61*a* of the back frame 61, and the guide part 66*a* of the pressing tool 66 and the guide part 65*a* of the tilting part 65 are fitted into each other. In view of the fact that the load is applied to a part above the center of the operating mechanism 6M when the seated person leans against the backrest 62, the elastic body 67 is not provided in the lower half of the base part 64 where there is little occasion to perform a function in a substantially, however, provision of the elastic body 67 in this position shall not be precluded.

Figure 33:
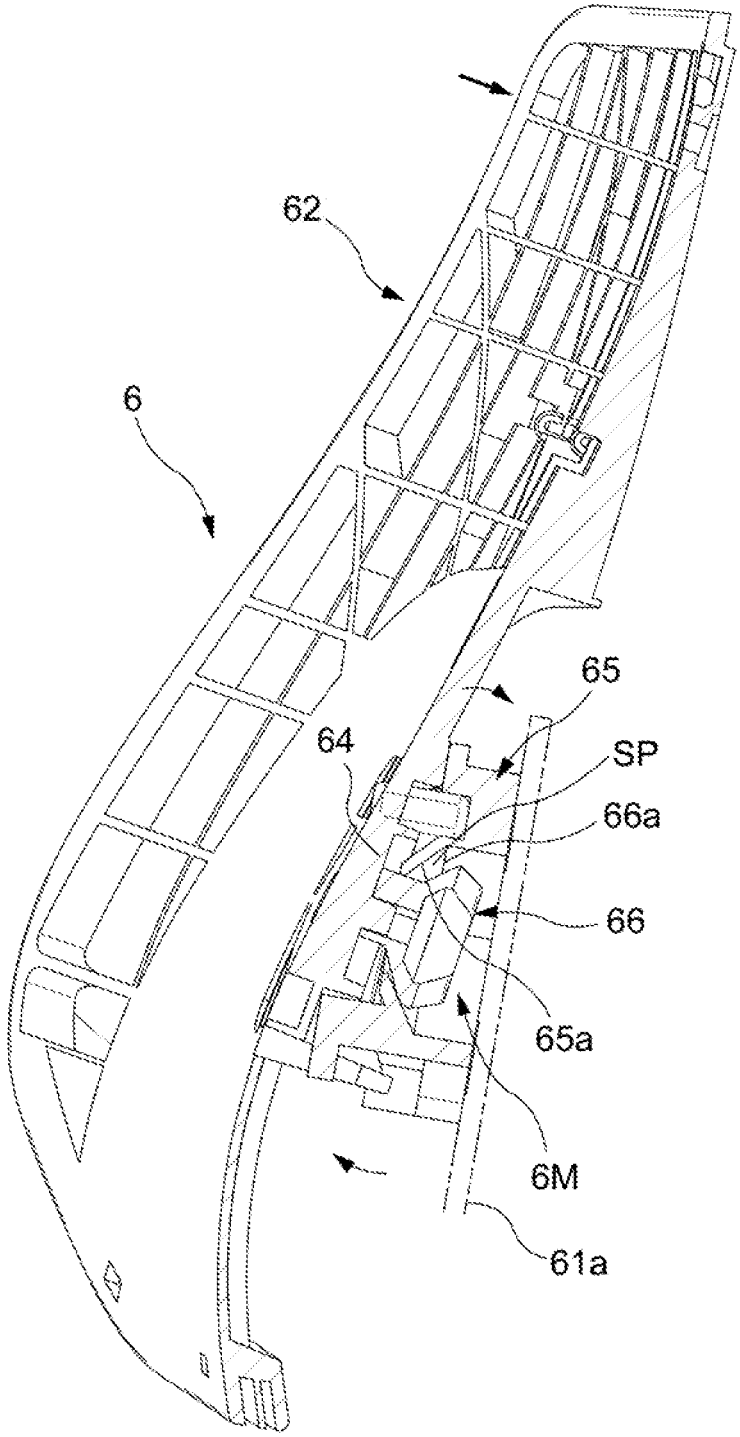
FIG. 33 is an operation explanatory diagram corresponding to FIG. 31.
Figure 34:
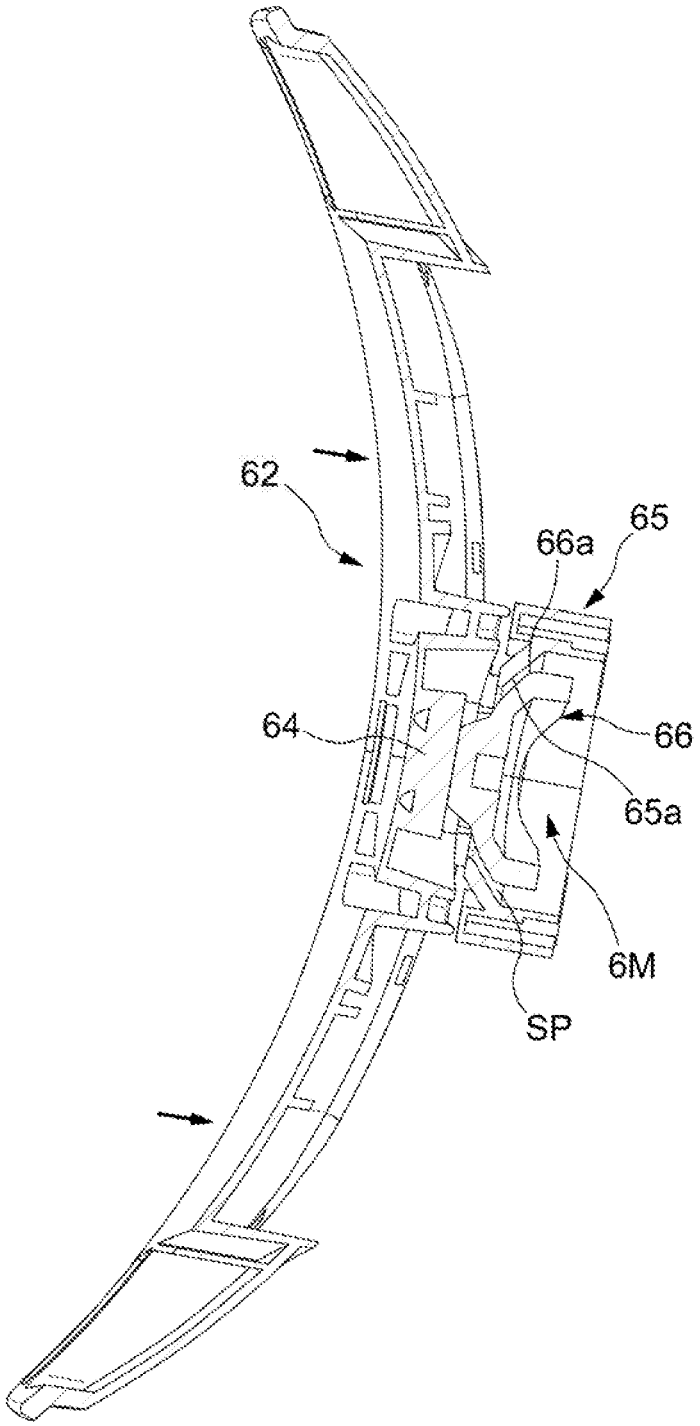
FIG. 34 is an operation explanatory diagram corresponding to FIG. 31.
Figure 35:
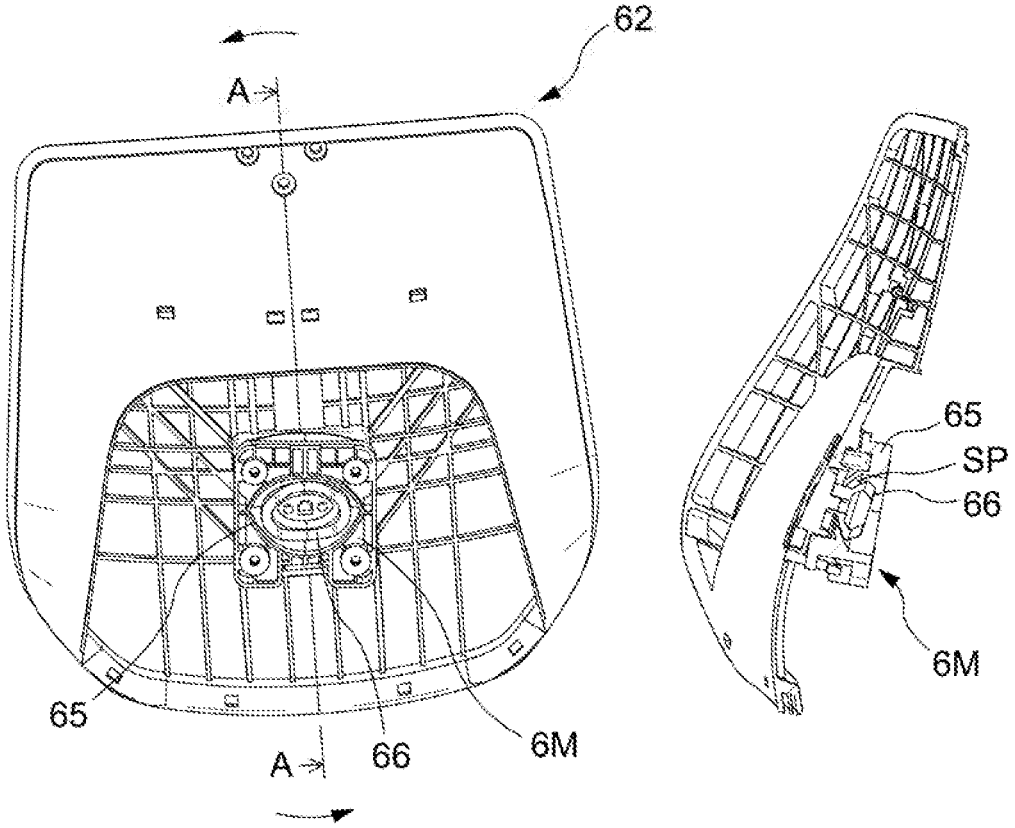
FIG. 35 is an operation explanatory diagram according to a turning operation of a backrest.

FIG. 33 illustrates a rearward tilted state when a load is applied to the upper part of the back 6, and FIG. 34 is a plane cross section thereof. Further, FIG. 35 illustrates a turning operation of the back 6 in a case where the seated person twists its body and the like.

That is, the backrest 62 is disposed in a positional relationship where the backrest 62 moves against the elastic reaction force in the rearward direction and the turning direction while being supported by the elastic body 67, and a configuration is such that, when the elastic body 67 is deformed to the front, rear, right, or left in accordance with the amount of turning movement in the front, rear, right, or left directions, the reaction force returning the backrest 62 to a neutral position increases. The turning direction includes a turning movement in the left-right direction in front view, as illustrated in FIG. 35, and further, in a clockwise or counterclockwise direction in front view.

The guide part 65*a* of the tilting part 65 and the guide part 66*a* of the pressing tool 66 included in the base part 64 are guided to and stopped in a reference position illustrated in FIG. 31 because of the shape of the guide parts 66*a*, 65*a* by pressure contact with the elastic body 67. Subsequently, when the pressure contact is loosened due to an elastic body 67 being compressed by a load being applied due to receiving pressure from the seated person, the guide part 65*a* of the tilting part 65 and the guide part 66*a* of the pressing tool 66 included in the base part 64 are at least partly separated, as illustrated in FIGS. 33, 34, and 35, so that the backrest 62 moves freely. The base part 64 and the tilting part 65 relatively move relative to the reference position in accordance with an amount of the received pressure and when the load is removed, the operating position is automatically returned, along the guide parts 66*a*, 65*a*, to the neutral position of FIG. 31 where the ridge line 66*ax* and the valley line 65*ax* coincide with each other. At this time, the backrest 62 is configured so that a gap SP between the guide parts 66*a*, 65*a* widens in accordance with a movement in the rear direction with respect to the back frame 61, and as a result, a turning range in the left-right direction expands and a return reaction force generated when the load is removed increases in accordance with the amount of turning movement in both the left and right directions.

Figure 36:
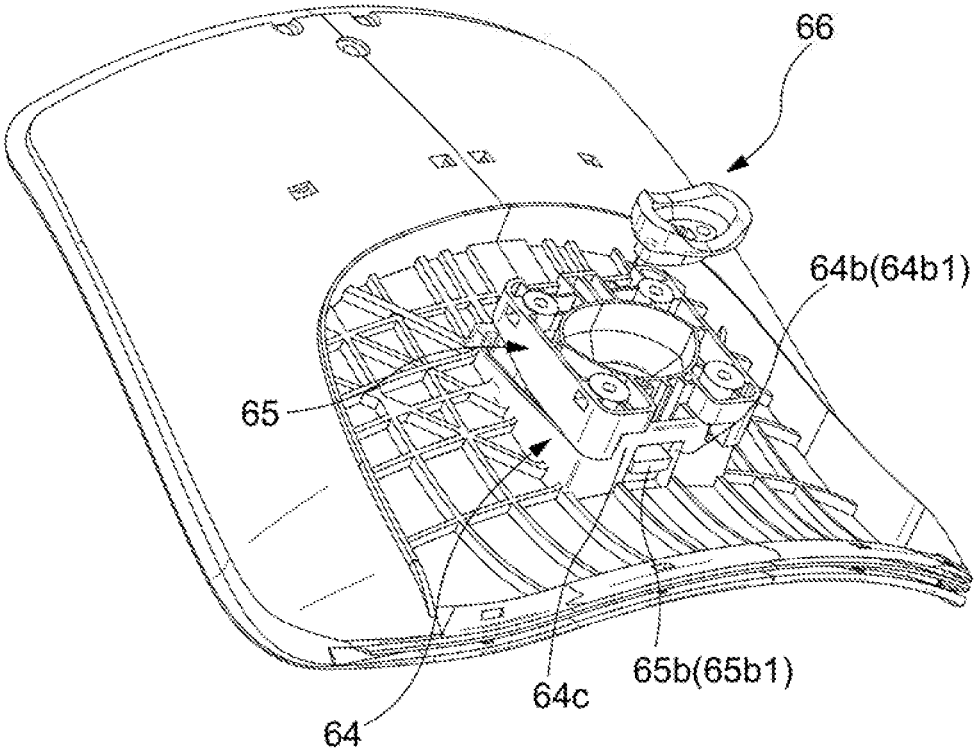
FIG. 36 is an exploded perspective view illustrating a restricting portion configured to restrict the operation of the back.

It is noted that, as illustrated in FIG. 36, the base part 64 and the tilting part 65 are provided with engaging parts 64*b*, 65*b* configured to restrict a relative movement of the base part 64 and the tilting part 65 in collaboration with the guide parts 65*a*, 66*a*. The base part 64 includes an upright wall 64*c* at a peripheral edge, and a window 64*b*1 to be the engaging part 64*b* opens in a rectangular shape in the upright wall 64*c*. On the other hand, in the tilting part 65, an L-shaped claw 65*b*1 to be the engaging part 65*b* is formed at a position displaced downward on the front side. Then, the base part 64 and the tilting part 65 are assembled with the claw 65*b*1 loosely fitted in the window 64*b*1, and a movable range of the tilting part 65 with respect to the base part 64 is restricted to a range where the claw 65*b*1 can move in the window 64*b*1. When the movable range is restricted, a part of the backrest load is also supported in this restriction portion.

As described above, the left-right turning operation of the back 6 occurs with respect to the back frame 61 and the seat 5 is attached to the front-rear swing part 3 to which the back frame 61 is attached, and thus, the back frame 61 and the seat 5 integrally swing in the left-right direction in front view, however, the backrest 62 further performs a different movement separately from the left-right turning operation of the seat 5 and the back frame 61.

It is noted that, in this embodiment, the base part 64 is attached to the backrest 62 and the tilting part 65 is attached to the side of the back frame 61, however, a configuration may be so that the base part 64 is attached to the side of the back frame 61 and the tilting part 65 is attached to the side of the backrest 62.

Next, a front support mechanism of the seat will be described.

As described above, in this chair, the seat 5 is configured to be supported to be swingable to the front, rear, right, or left with respect to the support base part 2, however, a feeling of pressure on a femoral region of the left and right legs of the seated person sitting on the chair configured to swing to front, rear, right, or left, may change to be unbalanced depending on the posture of the seated person. Further, in this chair, the back 6 is provided to tilt rearward behind the seat 5 and when the back 6 tilts rearward, the seat 5 moves together with the back 6 and performs an operation in which the front part of the seat 5 rises relative to the back part of the seat 5 which descends, and as a result, the seated person may experience a feeling of pressure on the femoral region of the legs when leaning rearward and anxiety or instability due to the legs of the seated person being lifted in the air.

Figure 38:
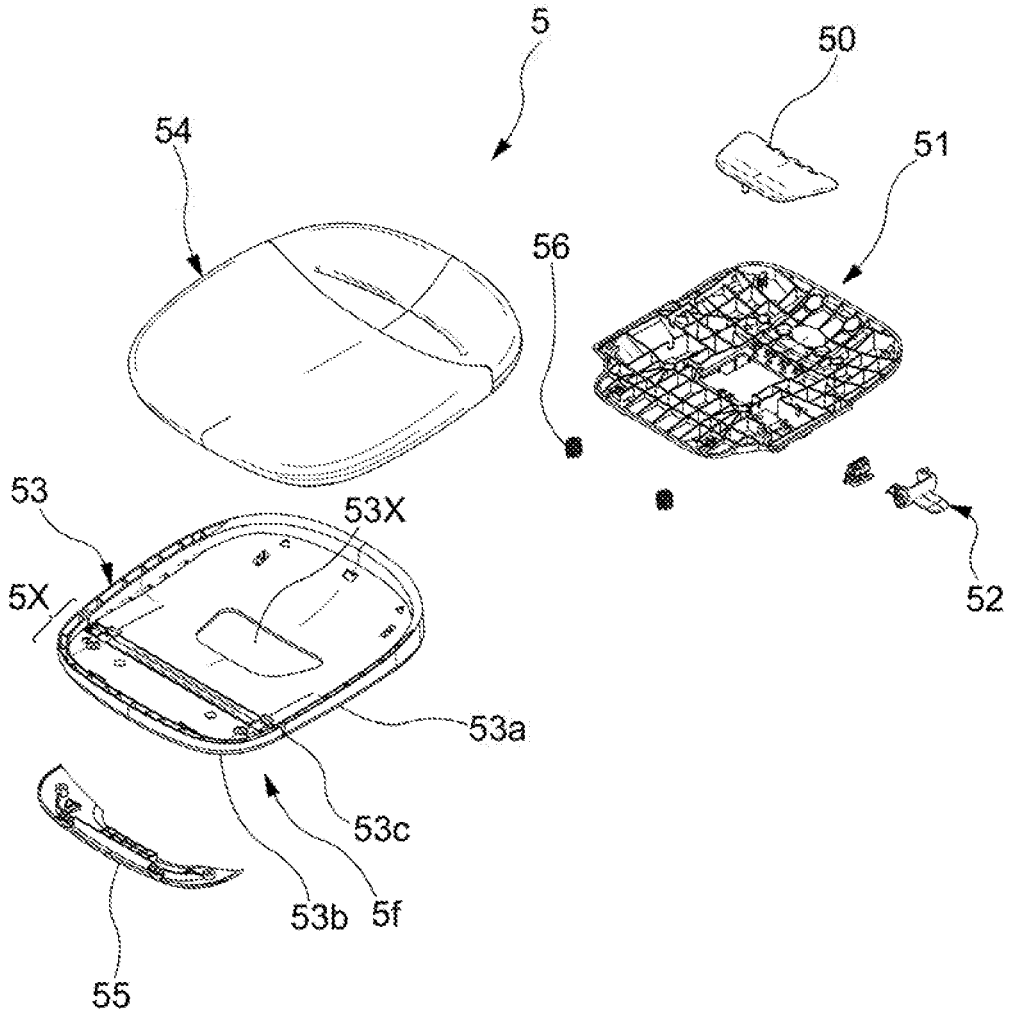
FIG. 38 is an exploded perspective view of the seat.
Figure 39:
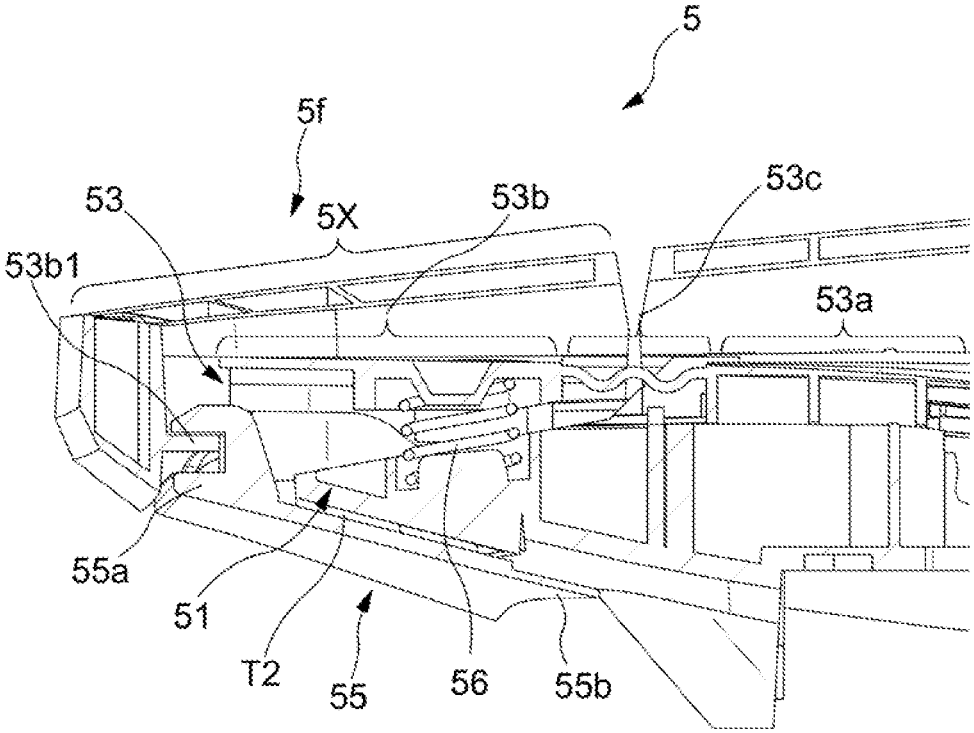
FIG. 39 is an enlarged cross-sectional view of a front part of the seat.

Thus, as illustrated in FIGS. 38, 37, and 39, this chair is provided with a deformation part 5X configured to change its shape in the up-down direction when receiving the load applied by seated person on a front part 5*f* of the seat 5.

The deformation part 5X is provided at a position receiving the weight of the legs of the seated person, and is configured to deform downward when receiving the weight of the legs and to return upward when the weight of the legs is removed.

Specifically, as illustrated in FIG. 38, in the seat 5, a cushion material 54 covered by a non-illustrated upholstery fabric is arranged on the seat inner shell 53, and the seat outer shell 51 is attached below the seat inner shell 53. The seat inner shell 53 is configured by connecting a rear part 53*a* and a front part 53*b* with a resin hinge part 53*c*, and the front part 53*b* is elastically deformed with respect to the rear part 53*a* with the resin hinge part 53*c* as a boundary. Together with this deformation, the cushion material 54 is also deformed, and thus, these portions configure the deformation part 5*x*.

Then, the seat outer shell 51 is fixed to the front-rear swing part 3, and the rear part 53*a* of the seat inner shell 53 is attached above the seat outer shell 51. Thus, the deformation part 5*x* including the front part 53*b* of the seat inner shell 53 is deformed toward the seat outer shell 51.

Figure 40:
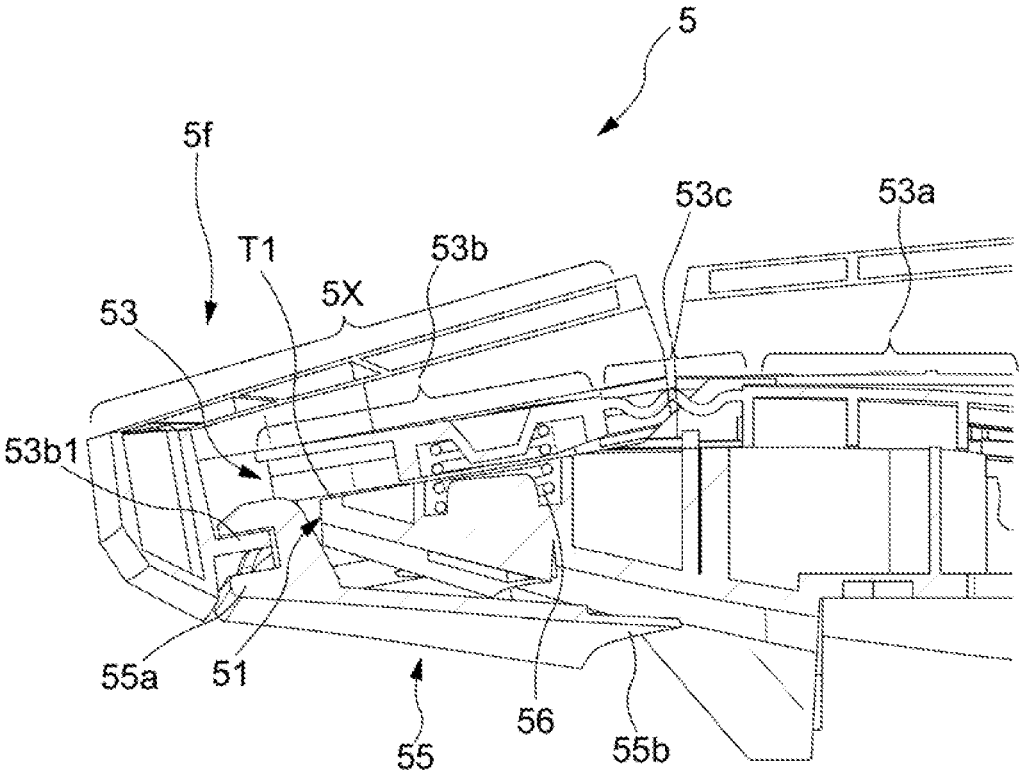
FIG. 40 is a diagram illustrating an operation of a deformation part.

In this embodiment, a front seat lower cover 55 is attached to the front part 53*b* forming the deformation part 5X of the seat inner shell 53, with the seat outer shell 51 interposed therebetween. Although FIG. 15 gives the impression that the front seat lower cover 55 is attached to the front part of the seat outer shell 51, the front seat lower cover 55 is actually arranged below the front part of the seat outer shell 51 in a non-connected state and is coupled to the deformation part 5X of the seat inner shell 53 above, as illustrated in FIGS. 39 and 40. As illustrated in FIG. 15, the left-right dimensions of the front seat lower cover 55 correspond substantially to the left-right dimensions of the front part 53*b* of the seat inner shell 53, and thus, a base end 55*a* of the front seat lower cover 55 is attached to an engaged part 53*b*1 (refer to FIGS. 39 and 40) set in the front part 53*b* of the seat inner shell 53, with the seat outer shell 51 interposed therebetween and a rear end 55*b* of the front seat lower cover 55 is shaped to extend rearward and downward along the seat outer shell 51.

At two locations on the left and right of the front part of the seat outer shell 51, compression springs 56 being elastic bodies are arranged at positions compressed between the front part 53*b* of the seat inner shell 53 and the front part of the seat outer shell 51.

When the deformation part 5X at the side of the seat inner shell 53 approaches the seat outer shell 51, as illustrated in FIGS. 39 and 40, that is, when the deformation part 5*x* of the seat inner shell 53 is deformed downward while compressing the compression spring 56, an appropriate portion of the front part 53*b* of the seat inner shell 53 abuts against an upper front surface of the seat outer shell 51 (abutment point T1). Conversely, when the front part 53*b* of the seat inner shell 53 moves upward in a direction where the deformation of the deformation part 5*x* is eliminated by the compression springs 56, as illustrated in FIGS. 40 and 39, the front seat lower cover 55 abuts against a lower front surface of the seat outer shell 51 (abutment point T2). That is, a deformable range of the deformation part 5*x* of a seat inner shell 53 is restricted both downward and upward.

Here, as illustrated in FIGS. 37 and 39, a resin hinge part 53*c* is shaped as a corrugated plate having a series of uneven portions, and the deformation part 5X has a structure that easily causes, in accordance with an unbalanced load received in a left-side region and a right-side region of the seat 5, regardless of the up-down direction, torsional deformation so that one side of the seat 5 in the left-right direction is lifted higher than the other side.

Figure 2:
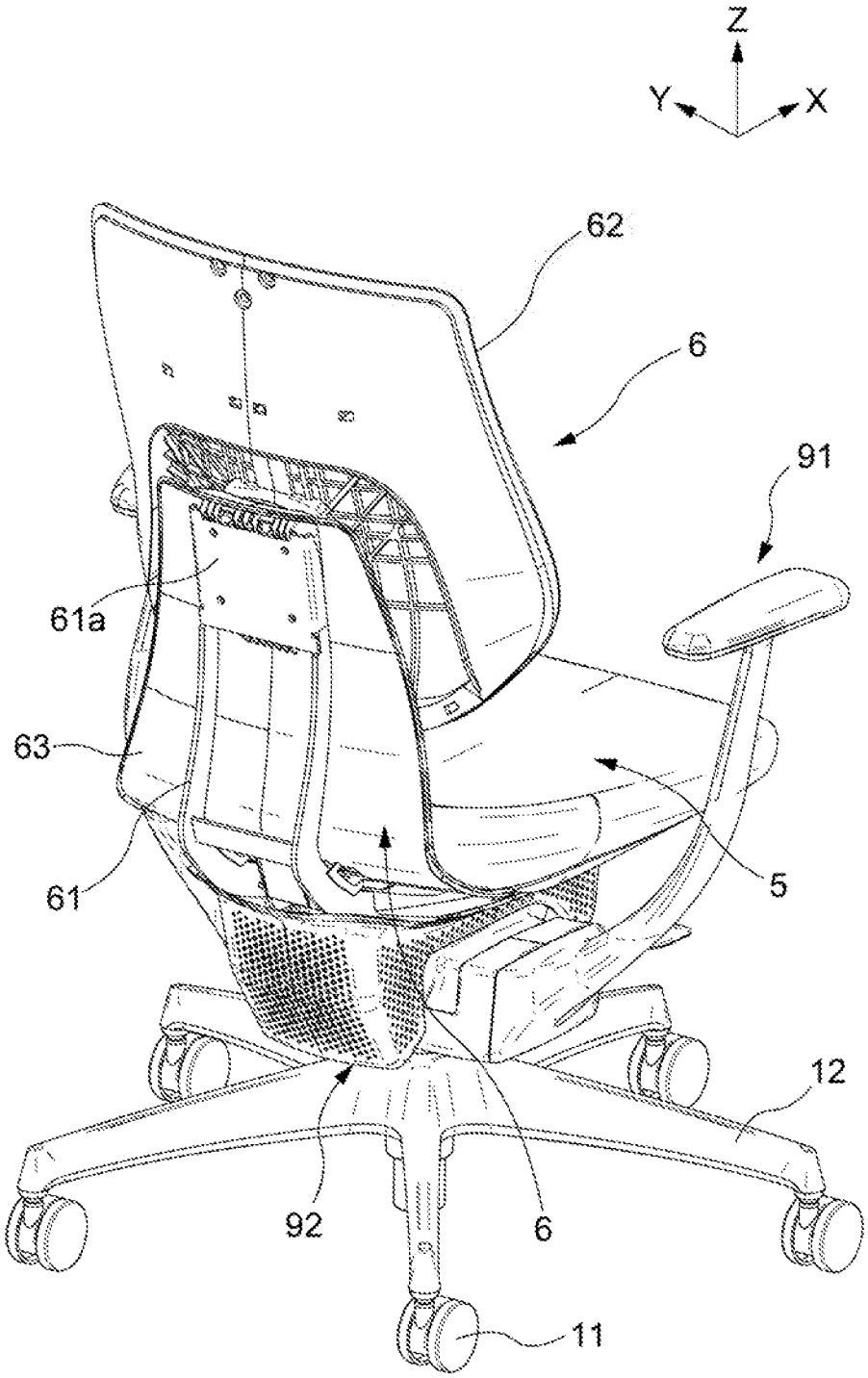
FIG. 2 is a perspective view thereof, as viewed obliquely from behind, in which a part of the chair is removed.

It is noted that, in the chair according to the present embodiment, as illustrated in FIGS. 1 and 2, a fixed attachment part 91 extending upward is attached to an arm attachment part 23 of the support base part 2 to bypass the seat 5 and even if the seat 5 swings to the front, rear, right, or left, the fixed attachment part 91 remains in a fixed position that does not interfere with the seat 5. Further, a movable cover mechanism 92 in which a plurality of covers are combined, is disposed below the seat 5 to not interfere with the relative operation of the front-rear swing part 3 and the left-right swing part 4 and to hide the front-rear swing part 3 and the left-right swing part 4.

As described above, in the chair according to the present embodiment, a front-rear swing part 3 being a movable portion that moves a state of receiving a load applied by seated person is configured to be operable to the front, rear, right, or left via a left-right swing parts 4 being the support base portion, a flange part 31*b* is provided on the vertical surface 31*a* of a plate member PM of the front-rear swing part 3 being the movable portion, and the flange part 31*b* has a guide surface 31*b*1 extending in a lateral direction and for moving a rolling body 45 in the longitudinal direction; and a lateral dimension of the guide surface 31*b*1 is greater than a thickness of the plate member PM. The flange part 31*b* and the portion of the plate member PM forming the vertical surface 31*a* around the flange part 31 *b* are integrally formed of metal; the flange part 31*b* has a shape formed around the entire circumference of a guide hole 34 opened in the vertical surface 31*a*. The rolling body 45 is provided so as to be roll independently on the left and right along the guide surface 31*b*1.

With such a configuration, the pressure receiving area of the guide hole 34 in contact with the rolling body 45 is increased, and load distribution can be achieved, resulting in improved durability. Furthermore, by providing the flange part 31*b* integrally with the plate member PM being the movable portion with metal, high strength can be secured, and a rib effect by the flange part 31*b* can also be expected. At the result, the rolling body 45 can be reliably supported and easily rolled without thickening the plate member PM. Further, the chair that moves while sitting is particularly applied high load, so the present invention is particularly effective. Furthermore, When the front-rear swing part 3 being the movable portion receives a load applied by seated person and moves in the front, rear, left, or right under the support of the left-right swing part 4 *b*, even if the shaft center positions of the left and right rolling bodies 45 are shifted from the guide surface 31*b*1, operation can be secured. Further, even if one of the left and right of the left-right swing part 3 being the movable portion is in a state of higher than the other when the left-right swing part 3 being the movable portion operates a front-rear direction and a right-left direction, one of the rolling body 45 can be in contact with the lower edge of the guide surface 31*b* and the other with the upper edge of the guide surface 31*b*, and the rolling body 45 can perform an operation in which one of left and right moves rolling body forward or rotates backward, and the other moves backward or rotates backward, so that it is possible to appropriately respond to right and left unbalanced external force or movement.

Further, the lateral dimension of the guide surface 31*b*1 is substantially uniform over the entire circumference, therefore, the region in contact with the rolling body 45 can be secured over the entire circumference.

Further, the flange part 31*b* is formed by plastic deformation processing of the plate member PM around the guide hole 34, the hardness of the flange part 31*b* can be increased by work hardening across the entire circumference, and at the same time, a smooth surface can be obtained across the entire circumference by the ironing effect at the time of processing.

Further, the flange part 31*b* is formed to extend from the guide hole 34 outward the left-right direction of the chair, therefore, the width of support is wider than that of the shape extending from the guide hole 34 inward the left-right directions, and stable support of the chair is possible.

Further, an end part of the guide hole 34 has a shockless shape that lefts the center of gravity of the movable portion in order to mitigate a shock due to the collision with the rolling body 45, therefore, the synergetic effect of the formation of the flange portion 31*b* and the shockless can improve the durability and the strength.

Further, even if the guide surface 31*b*1 is made so strong, the rolling body can not withstand strength when the rolling body 45 are resin so on. However, it is possible to ensure smooth rotation and strength against the guide surface, by making the rolling element 45 into a metal bearing 45*a*.

Further, the shortest dimension D from the both end parts of the guide hole 34 to the edge of the plate member PM is set to at least 15 mm or more. However, when their shortest dimension D is smaller, the plate member cannot withstand the loads during processing or in use and is deformed. However, and when the thickness of a thin plate of 2 to 6 mm is set to 15 mm or more, an appropriate processing can be performed without deforming the plate member PM.

Further, the front-rear swing part 3 being the movable portion is supported by the left-right swing part 4 being the supporting portion at two locations on the front and rear, and any one of the front and rear support structures of the chair, that is, in this embodiment the front support structure includes the rolling elements 45 and the guide surfaces 31*b*1, and the other, that is, in this embodiment the rear support structure is configured by a different link support structure. And when the front and rear support structures are different, a load that is biased forward and backward is applied, the load burden between the rolling body and the guide surface increases, the left and right unbalanced behaviors are easily collected, and it is in particularly effective to apply to the present invention.

Although an embodiment of the present invention was explained above, the specific configuration of each part is not limited to those in the embodiment described above.

For example, in the embodiment above, the guide hole 34 is formed in the movable portion of the chair, and the bearing 45*a* being the rolling body 45 is a supporting portion. Then, the guide hole 34 may be provided on the support portion side, and the bearing 45*a* being the rolling element 45 may be configured opposite to the movable portion of a chair.

Further, the movable part is not limited to the front-rear swing part as in the above embodiment as long as it is applied between the movable part and the supporting part, and in the case where the left-right swing part is supported by the guide hole and the bearing, the above-described burring structure may be applied to the left-right swing parts.

Various other changes may be applied to other configurations without departing from the spirit of the present invention.

DESCRIPTION OF REFERENCE NUMERALS

3 . . . Movable portion (front-rear swing part)
4 . . . Support portion (left-right swing part)
31*a* . . . Vertical surface
31*b* . . . Flange part
31*b*1 . . . Guide surface
34 . . . Guide hole
45 . . . Rolling body
45*a* . . . Bearing
D . . . shortest dimension
PM . . . Plate member

The invention claimed is:

1. A chair comprising:

a support portion;

a movable portion that can move to the front, rear, right, or left via the support portion in a state of receiving a load applied by seated person;

a flange part provided on a vertical surface of a plate member of the movable portion or the support portion, the vertical surface extending in a vertical direction, the flange part comprising: a guide surface extending in a lateral direction and for moving a rolling body in the longitudinal direction, and a lateral dimension of the guide surface is greater than a thickness of the plate member, and the flange part and the portion of the plate member part forming the vertical surface around the flange part are integrally formed of metal; the flange part has a shape formed around the entire circumference of a guide hole opened in the vertical surface, the rolling body is provided so as to be roll independently on the left and right along the guide surface.

2. The chair according to claim 1, wherein the lateral dimension of the guide surface is substantially uniform over the entire circumference.

3. The chair according to claim 1, wherein the flange part is formed by plastic deformation processing of the plate member around the guide hole.

4. The chair according to claim 1, wherein the flange part is formed to extend from the guide hole from the guide hole outward in the left-right direction of the chair.

5. The chair according to claim 1, wherein the entire circumference of the guide hole comprising:

a first circumference part having a first arc, a center of the first arc being toward the rolling body; and a second circumference part having a second arc, a center of the first arc being toward the rolling body, the second circumference part located vertically lower than the first circumference part;

wherein a radius of the second arc is shorter than a radius of the first arc.

6. The chair according to claim 1, wherein the rolling body is configured of a metal bearing.

7. The chair according to claim 1, wherein the shortest dimension from the both end parts of the guide hole to the edge of the plate member is set to at least 15 mm or more.

8. The chair according to claim 1, wherein the movable portion is supported by the support portion at two locations at a front and at a rear, wherein at one of the locations the movable portion is supported by the rolling body and the guide surface, and at the other location the movable portion is supported by a different structure than said one of the locations.

* * * * *